US008800251B2

(12) United States Patent
Brinkman et al.

(10) Patent No.: US 8,800,251 B2
(45) Date of Patent: Aug. 12, 2014

(54) APPARATUS AND METHOD FOR SHAPING AND HOLDING A BAG IN AN OPEN CONDITION

(75) Inventors: Jacob Brinkman, Hamilton (NZ); John Koke, Duncan, SC (US)

(73) Assignee: Sealed Air (New Zealand), Hamilton (NZ)

( * ) Notice: Subject to any disclaimer, the term of this patent is extended or adjusted under 35 U.S.C. 154(b) by 744 days.

(21) Appl. No.: 12/962,885

(22) Filed: Dec. 8, 2010

(65) Prior Publication Data

US 2012/0144779 A1 Jun. 14, 2012

(51) Int. Cl.
*B65B 43/26* (2006.01)
*B65B 43/46* (2006.01)

(52) U.S. Cl.
USPC ..... 53/459; 53/260; 53/384.1; 53/564; 53/570; 53/573

(58) Field of Classification Search
USPC ..... 53/564, 441, 459, 573, 384.1, 570, 260
See application file for complete search history.

(56) References Cited

U.S. PATENT DOCUMENTS

| | | | | |
|---|---|---|---|---|
| 2,561,410 A | | 7/1951 | Peters | |
| 2,758,764 A | | 8/1956 | Piazze | |
| 2,885,580 A | | 5/1959 | Scanlon et al. | |
| 2,885,850 A | | 5/1959 | Smith | |
| 2,901,875 A | | 9/1959 | Hultkrans et al. | |
| 3,138,907 A | | 6/1964 | Gerbe | |
| 3,563,002 A | | 2/1971 | Givin | |
| 4,793,124 A | * | 12/1988 | Anderson | 53/588 |
| 4,974,393 A | | 12/1990 | Rich et al. | |
| 5,315,812 A | | 5/1994 | Germunson | |
| 5,385,002 A | | 1/1995 | Cundall | |
| 5,398,487 A | * | 3/1995 | Inman et al. | 53/567 |
| 5,421,144 A | * | 6/1995 | Inman et al. | 53/576 |
| 5,588,278 A | * | 12/1996 | Wynn et al. | 53/399 |
| 5,619,839 A | | 4/1997 | Peppard et al. | |
| 5,628,168 A | * | 5/1997 | Inman et al. | 53/567 |
| 5,661,956 A | * | 9/1997 | Tardif | 53/588 |
| 6,138,443 A | * | 10/2000 | Taylor et al. | 53/492 |
| 6,564,534 B2 | * | 5/2003 | Poulton et al. | 53/570 |
| 6,604,344 B2 | | 8/2003 | Bussey, Jr. et al. | |
| 6,662,532 B1 | | 12/2003 | Droog et al. | |
| 6,834,472 B2 | * | 12/2004 | Kujubu et al. | 53/64 |
| 7,712,290 B2 | | 5/2010 | Imao | |

FOREIGN PATENT DOCUMENTS

| | | |
|---|---|---|
| DE | 937 156 | 12/1955 |
| DE | 36 40 581 A1 | 6/1988 |
| DE | 42 03 884 A1 | 8/1993 |

* cited by examiner

*Primary Examiner* — Thanh Truong
*Assistant Examiner* — Gloria R Weeks
(74) *Attorney, Agent, or Firm* — Mark B. Quatt

(57) ABSTRACT

An apparatus for shaping and holding a bag in an open condition, and holding the bag in this condition during loading of the bag with a product, includes an inner stationary ring; a plurality of finger assemblies, each finger assembly comprising a finger adapted to press against the interior of the bag mouth, and a force-transferring member to which the finger is operatively connected; an outer rotatable ring, concentric with the inner ring; a push rod operatively connected to each respective finger assembly; and a motive device adapted to cause rotation of the outer ring relative to the inner ring to effect coordinated radial movement of the fingers relative to the interior surface of the bag. A method of shaping and holding a bag in an open condition, and holding the bag in the shaped, open condition during loading of the bag with a product, is also disclosed.

20 Claims, 29 Drawing Sheets

APPARATUS AND METHOD FOR SHAPING AND HOLDING A BAG IN AN OPEN CONDITION

FIELD OF THE INVENTION

The present invention relates to an apparatus and method for shaping and holding a bag in an open condition, and holding the bag in the shaped, open condition during loading of the bag with a product.

BACKGROUND OF THE INVENTION

Many packaging applications, especially food packaging, require or benefit from the use of bags made from various thermoplastic materials and structures.

These bags are commonly used in large scale meat processing and/or packaging systems where production speed and efficiency are important. Bags to be used in these systems can be provided in various forms. For example, bags can be supplied in the form of a box of taped bags, the bags disposed on the tapes in an imbricated (shingled) arrangement. Alternatively, the bags can be supplied on a roll, with adjoining bags connected by a transverse line of serrations or perforations. In another alternative, the bags can be made from plastic tubing, converted into bags on demand.

At the loading station of a conventional bag loading system, each bag can be opened and then loaded with an article such as a fresh red meat subprimal or smoked and processed meat, poultry, cheese, or other perishable food product, or other product. This process can be done manually or mechanically.

Bags, in particular those intended for use in packaging fresh red meat subprimals and the like, are supplied to the processor in a variety of bag widths, in order to accommodate the variety of meat cuts. Currently, bag loading systems for this segment of the food processing industry are typically capable of handling only one bag size at a time. To accommodate a different meat cut, of different size, it is desirable to switch to a different bag width. This however often involves costly downtime for retooling. To be sure, a currently commercial bag loading system marketed by Cryovac as the BL 145 bag loading system does handle more than one bag width, but with significant limitations on the variability in bag widths that can be conveniently handled by the system.

Also, for a given product, it is desirable to minimize the chosen bag size needed (i.e. typically bag width) to achieve packaging efficiency and reduce cost. For example, loading a round product in a square opening requires greater bag width (and concomitantly higher cost) than loading the same round product in an optimally sized round opening.

It is therefore desirable to provide an apparatus and method for opening a bag, including an apparatus and method for holding the open bag in an open condition during loading of the bag with a product, which apparatus and method provide one or more of the following capabilities:

sequentially loading bags having a wide variety of bag widths on a single loading device without any substantial adjustment of or change in the apparatus.

configuring the apparatus to form a wide variety of bag opening shapes (i.e. bag mouths that upon opening having a cross-sectional geometry that is e.g. round, oval, half round, half oval, square, rectangular, pentagonal, hexagonal, triangular, etc.), thus providing a method of minimining the bag width required to package a particular product.

controlling the movement of a plurality of fingers with a single control axis which synchronizes the motion of all the fingers and minimizes the cost of the required controls.

controllably tensioning the bag opening over the full range of bag width with little or no additional mechanisms or sensors required. This feature is advantageous because in use, excessive tension should not applied to the bag opening. This could stress the material from which the bag is made beyond its yield point. The apparatus of the invention should ensure that an appropriate level of tension is applied to hold the bag in place throughout the loading operation. On the one hand, a minimal tension is required in order to avoid bag slippage during loading of a product into the bag. On the other hand, the tension should not be so high that damage to the bag occurs during the opening and loading steps.

minimizing material consumption when packaging products of variable size by selecting a given bag and adjusting the geometry of the bag opening.

including a contamination guard in the sealing zone of the bag opening to reduce or eliminate contamination of the seal area during the loading process. This is useful when loading a wet protein product like pork, beef or poultry into a bag.

including supplemental stretching fingers which move in a single axis to stretch the bag mouth for presentation of the bag to a sealing mechanism without any pleats.

SUMMARY OF THE INVENTION

In a first aspect, an apparatus for shaping and holding a bag in an open condition, and holding the bag in the shaped, open condition during loading of the bag with a product, wherein the bag comprises a bag mouth having an interior and exterior surface, comprises an inner stationary ring; a plurality of finger assemblies, each finger assembly comprising a finger, the finger adapted to press against the interior of the bag mouth, and a force-transferring member to which the finger is operatively connected; an outer rotatable ring, the outer rotatable ring being concentric with the inner stationary ring; a push rod operatively connected to each respective finger assembly; and a motive device adapted to cause rotation of the outer rotatable ring relative to the inner stationary ring to effect coordinated radial movement of the fingers relative to the interior surface of the bag.

Optionally, according to various embodiments of the first aspect of the invention, taken alone or in any suitable combination of these embodiments:

the force-transferring member comprises an elongate arm mounted on the inner stationary ring.

the force-transferring member comprises a set of parallel bars mounted on the inner stationary ring.

the force-transferring member comprises a finger arm engaged in a sliding mechanism, the sliding mechanism mounted on the inner stationary ring.

the push rod is operatively connected to each respective finger assembly through a linking rod to a respective elongate arm.

the push rod is operatively connected to each respective finger assembly through a linking rod to a respective set of parallel bars.

the push rod is operatively connected to each respective finger assembly through a respective finger arm.

a loading funnel is disposed above or upstream of the plane of the inner stationary ring and outer rotatable ring.

at least two fingers are moveable in a single axis.

a sheet is attached to each finger.

the apparatus further comprises a third ring, concentric and coplanar with the outer rotatable ring; the third ring adapted to rotate with the outer rotatable ring to effect further opening of the bag mouth, and then rotate further, while the outer rotatable ring rotates in the reverse direction to effect closure of the bag mouth after the bag has been loaded with a product.

the apparatus further comprises a seal bar mechanism adapted to seal the bag mouth closed after the bag has been loaded.

the outer rotatable ring is substantially coplanar with the inner stationary ring.

In a second aspect, a method of shaping and holding a bag in an open condition, and holding the bag in the shaped, open condition during loading of the bag with a product, comprises providing a partially open bag, wherein the bag comprises a bag mouth having an interior and exterior surface;

providing an apparatus comprising an inner stationary ring; a plurality of finger assemblies, each finger assembly comprising a finger, the finger adapted to press against the interior of the bag mouth, and a force-transferring member to which the finger is operatively connected; an outer rotatable ring, the outer rotatable ring being concentric with the inner stationary ring; a push rod operatively connected to each respective finger assembly; and a motive device adapted to cause rotation of the outer rotatable ring relative to the inner stationary ring to effect coordinated radial movement of the fingers relative to the interior surface of the bag;

moving the partially open bag relative to each finger such that each finger is inserted into the bag mouth of the partially open bag;

activating the motive device to cause rotation of the outer rotatable ring relative to the inner stationary ring so as to effect coordinated radial movement of the fingers relative to the interior surface of the bag, such that the fingers press against the interior surface of the bag with a force sufficient to shape and hold the bag in an open condition; and loading the bag with a product.

Optionally, according to various embodiments of the second aspect of the invention, taken alone or in any suitable combination of these embodiments:

the force-transferring member comprises a finger arm engaged in a sliding mechanism, the sliding mechanism mounted on the inner stationary ring.

the force-transferring member comprises a set of parallel bars mounted on the inner stationary ring.

the force-transferring member comprises an elongate arm mounted on the inner stationary ring.

the push rod is operatively connected to each respective finger assembly through a linking rod to a respective elongate arm.

the push rod is operatively connected to each respective finger assembly through a linking rod to a respective set of parallel bars.

the push rod is operatively connected to each respective finger assembly through a respective finger arm.

a loading funnel disposed above or upstream of the plane of the inner stationary ring and outer rotatable ring, at least two fingers are moveable in a single axis.

a sheet is attached to each finger.

after the step of loading the product into the bag, reactivating the motive device to cause rotation of the outer rotatable ring relative to the inner stationary ring, and to effect coordinated radial movement of the fingers relative to the interior surface of the bag, such that the fingers retract and release the loaded bag;

the apparatus further comprises a third ring, concentric and coplanar with the outer rotatable ring, wherein the third ring rotates in synchronization with the outer rotatable ring so as to effect coordinated radial movement of the fingers relative to the interior surface of the bag, such that the fingers press against the interior surface of the bag with a force sufficient to shape and hold the bag in an open condition; and, after the bag is loaded with a product, the third ring is rotated further, while the outer rotatable ring rotates in the reverse direction to effect closure of the bag mouth after the bag has been loaded.

the apparatus further comprises a seal bar mechanism adapted to seal the bag mouth closed after the bag has been loaded with a product.

the outer rotatable ring is substantially coplanar with the inner stationary ring.

BRIEF DESCRIPTION OF THE DRAWINGS

In the drawings presented by way of illustration of the invention.

DETAILED DESCRIPTION OF THE INVENTION

Figure 1:
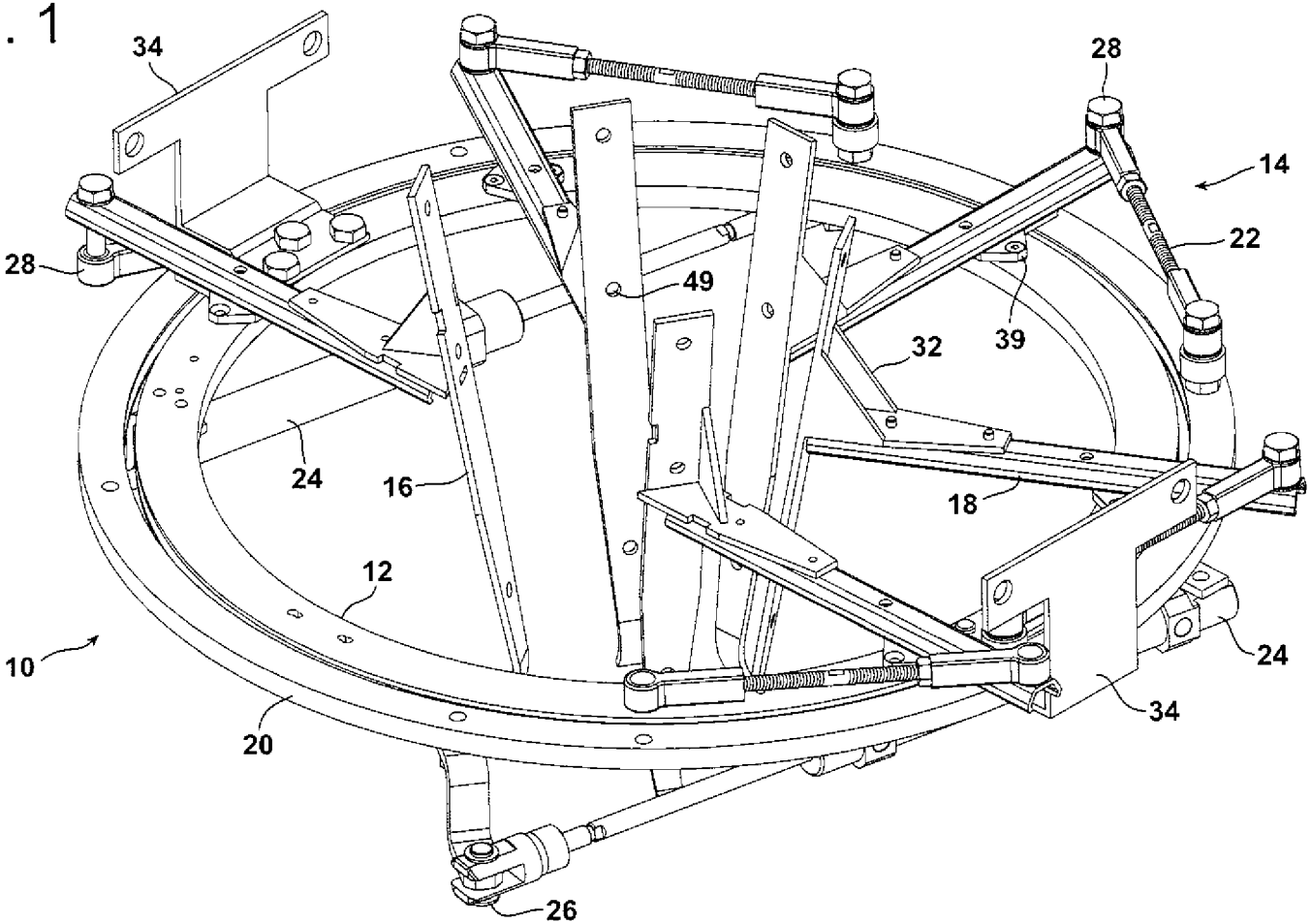
FIG. 1 is a perspective view of an apparatus with a plurality of fully retracted fingers.

Referring to FIGS. 1 to 5, and 12 to 14, the apparatus 10 includes an inner stationary ring 12; a plurality of finger assemblies 14, each finger assembly comprising a finger 16, the finger adapted to press against the interior of a bag mouth, and a force-transferring member 18 to which the finger is operatively connected; an outer rotatable ring 20, concentric with the inner stationary ring 12, and disposed outside inner ring 12; a push rod 22 operatively connected to each respective finger assembly; a motive device 24 adapted to cause rotational movement of the outer rotatable ring relative to the inner stationary ring to effect coordinated radial movement of the fingers relative to the interior surface of the bag; motive device linkage 26 for connecting motive device 24 to outer ring 20; push rod linkage 28 for connecting push rod 22 to force-transferring member 18; finger support bracket 32; apparatus mounting bracket 34; and finger end 36.

In one embodiment, the outer ring 20 is substantially coplanar with the inner ring 12. In other embodiments, the outer ring 20 is not substantially coplanar with the inner ring 12, but force can nevertheless be transmitted from the movement of the outer ring to the force-transferring member through e.g. a non-linear push rod 22, such as by a step-shaped push rod, or an intermediary linkage that enables transfer of force from the plane of the outer ring to the plane of the inner ring.

Outer ring 20 is in some embodiments in communication with inner ring 12 via ball bearings disposed in a race between the outer and inner rings; and/or via a high slip surface where the outer ring is in contact with the inner ring, etc.

Figure 4:
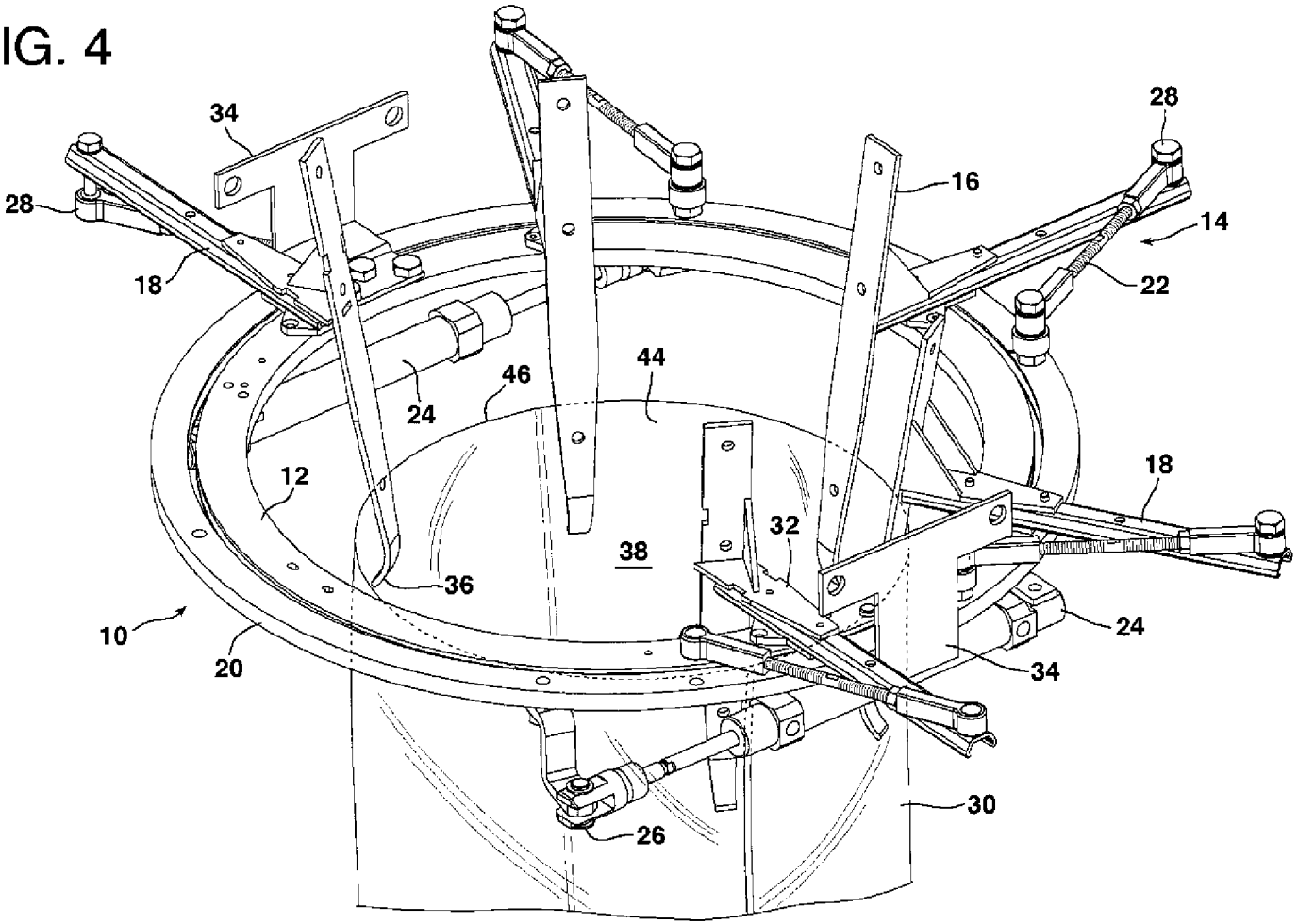
FIG. 4 is a perspective view of the apparatus of FIG. 3, with the plurality of fingers further spread out from their retracted position.
Figure 5:
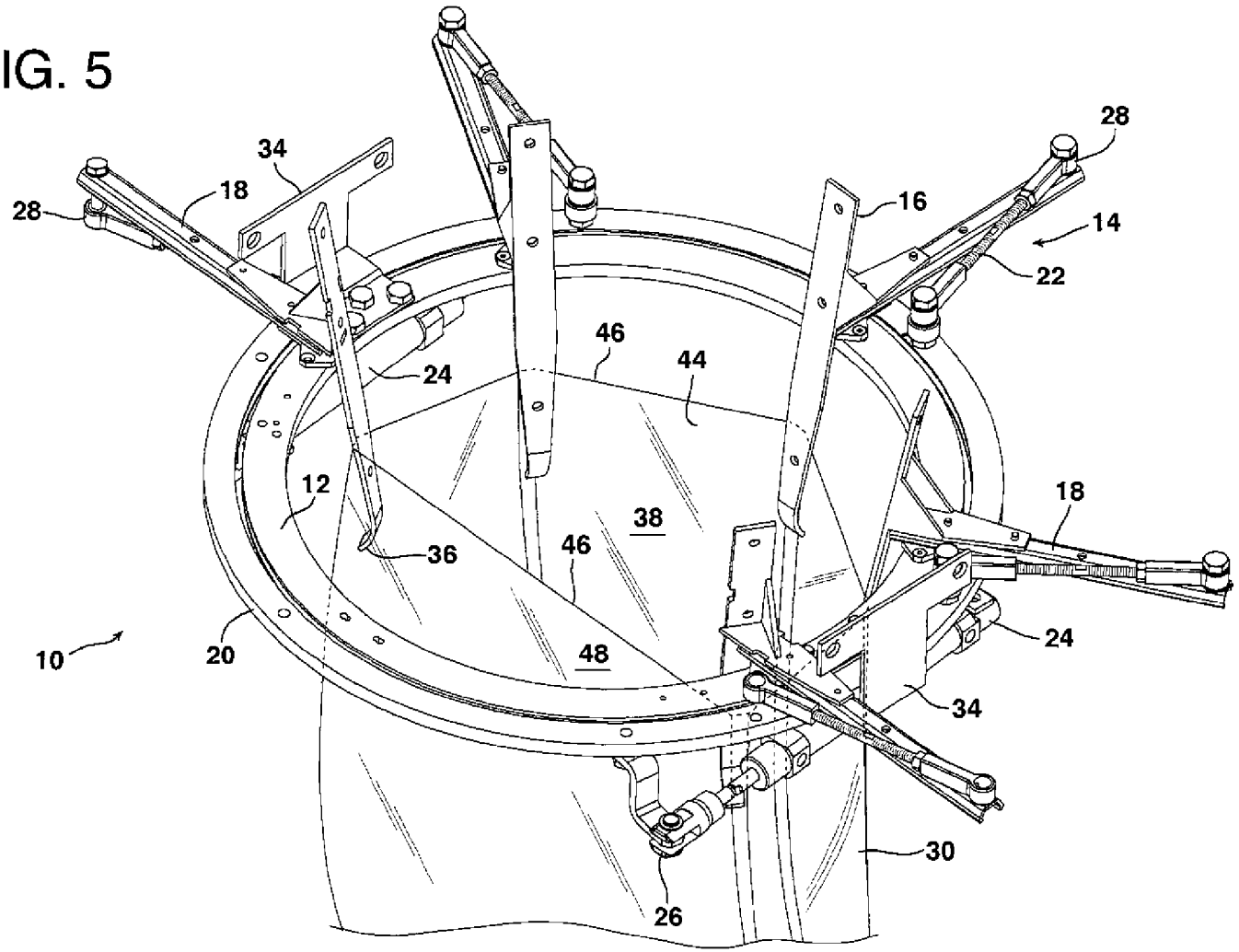
FIG. 5 is a perspective view of the apparatus of FIG. 4, with the plurality of fingers further spread out from their retracted position to their fully open configuration.
Figure 6:
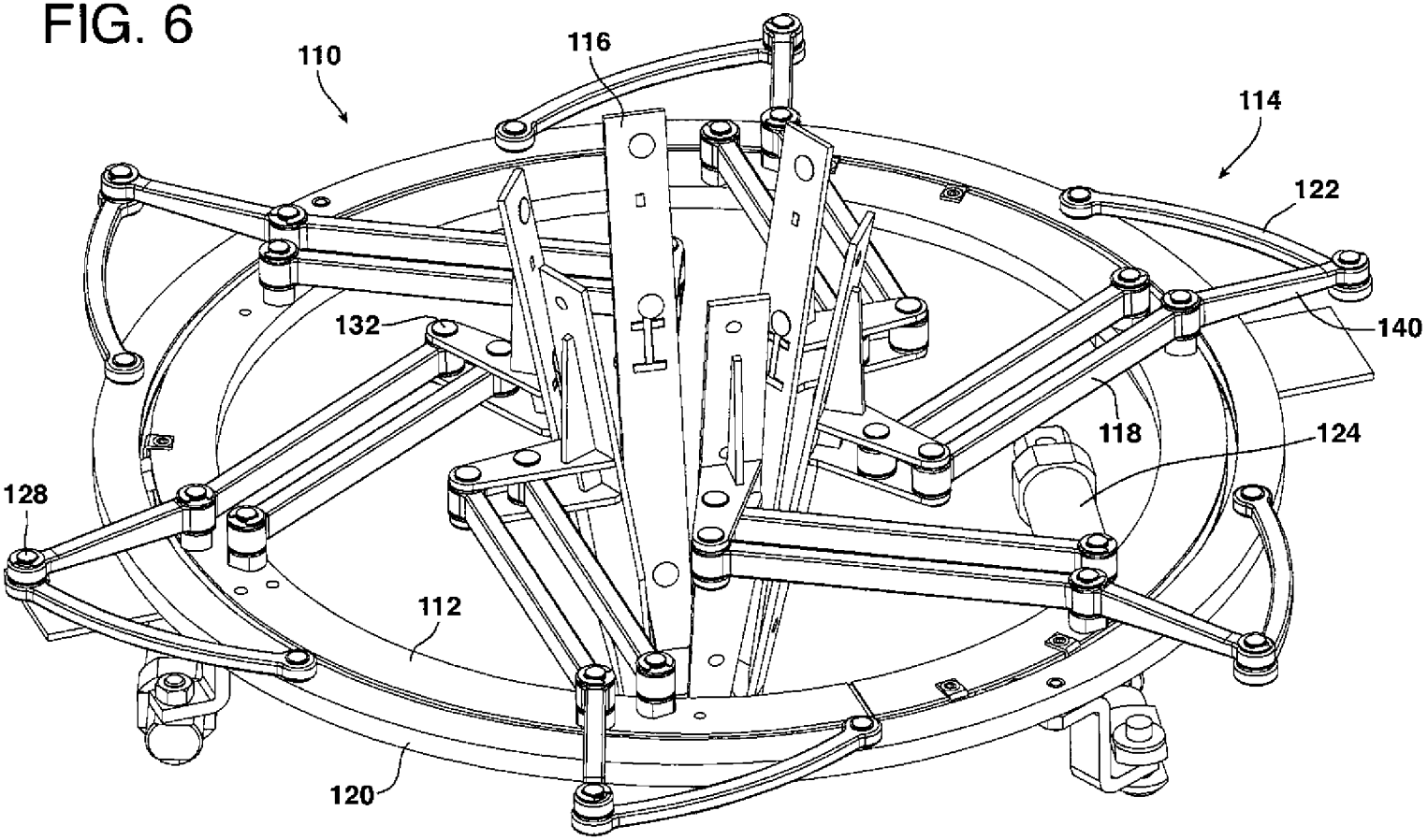
FIG. 6 is a perspective view of an apparatus like that of FIG. 1, but having a six finger configuration and an alternative finger assembly.
Figure 7:
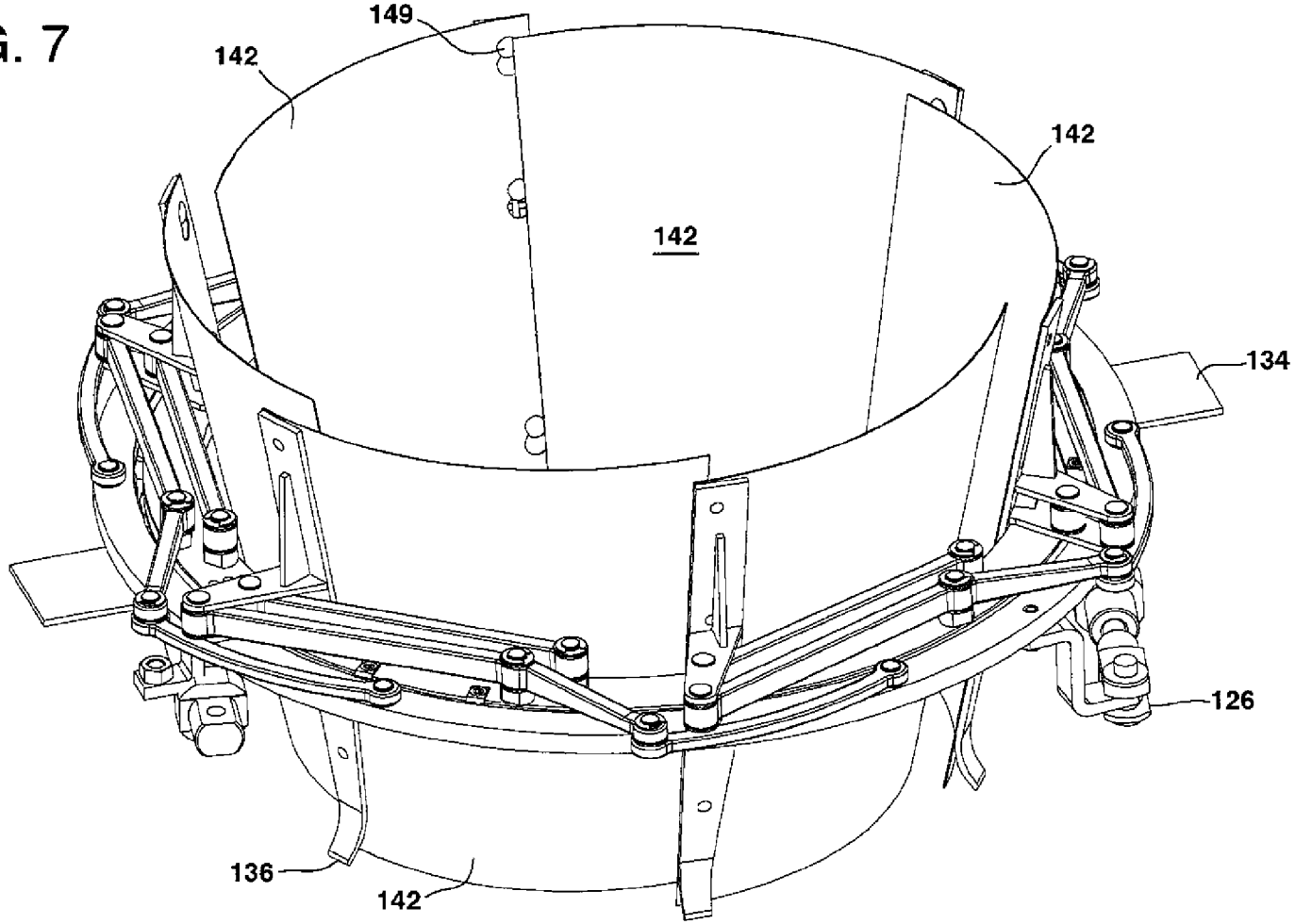
FIG. 7 is a perspective view of the apparatus of FIG. 6, with the plurality of fingers spread out from their retracted position to their fully open configuration.
Figure 15:
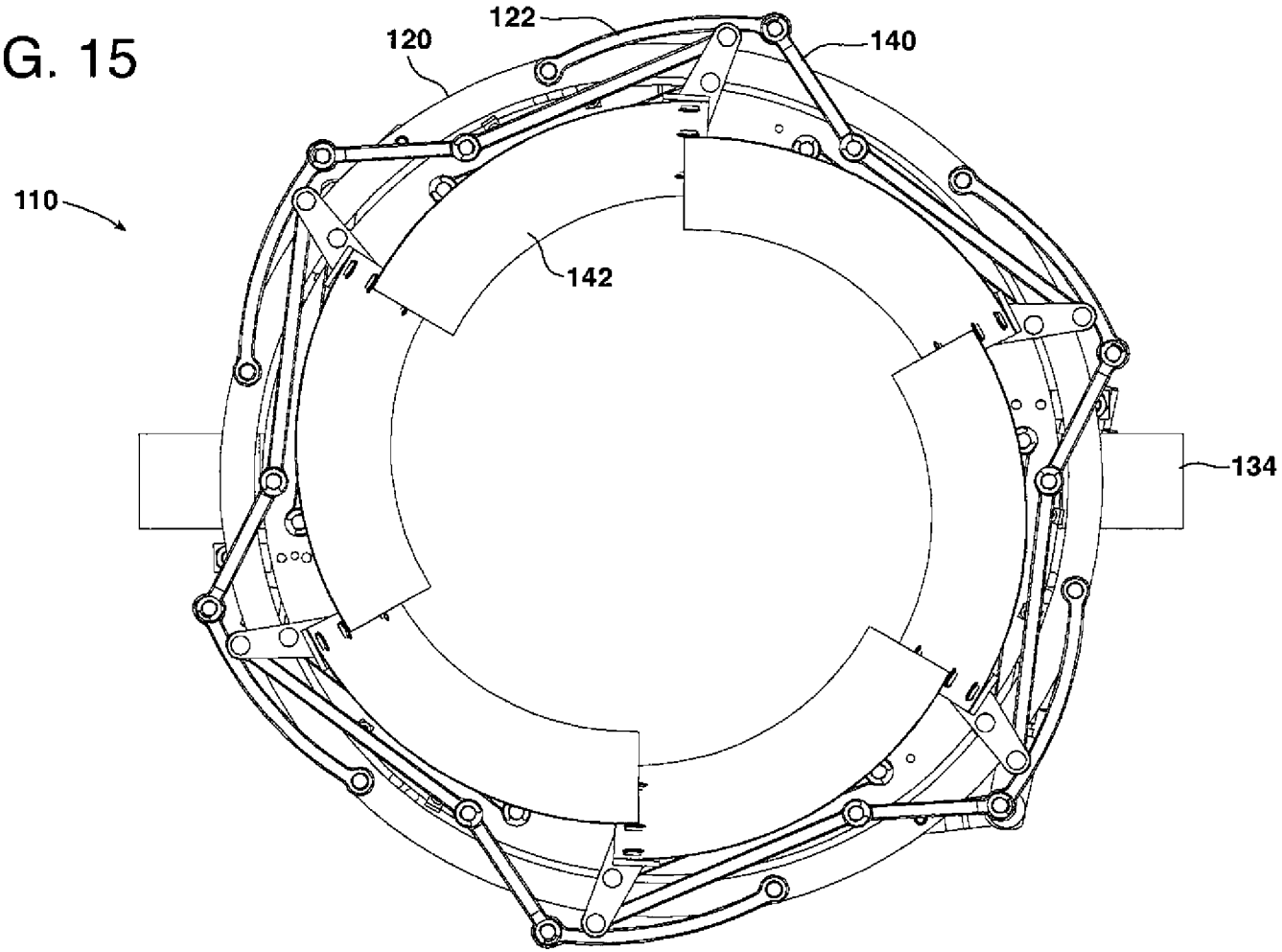
FIG. 15 is a top plan view of an apparatus similar to that of FIG. 7.

The apparatus 110 shown in FIGS. 6, 7 and 15 is similar to that of FIGS. 1 to 5, but having a six finger configuration and an alternative finger assembly described in more detail below. Thus, apparatus 110 is similar in most respects to apparatus 10; inner stationary ring 112 is like inner stationary ring 12; each finger assembly 114 similar in function to finger assembly 14; finger 116 like finger 16; force-transferring member 118 similar in function to force-transferring member 18; outer rotatable ring 120 like outer rotatable ring 20; push rod 122 like push rod 22; motive device 124 like motive device 24; motive device linkage 126 like motive device linkage 26; finger support bracket 132 like finger support bracket 32; apparatus mounting bracket 134 similar in function to apparatus mounting bracket 34; and finger end 136 like finger end 36.

Figure 9:
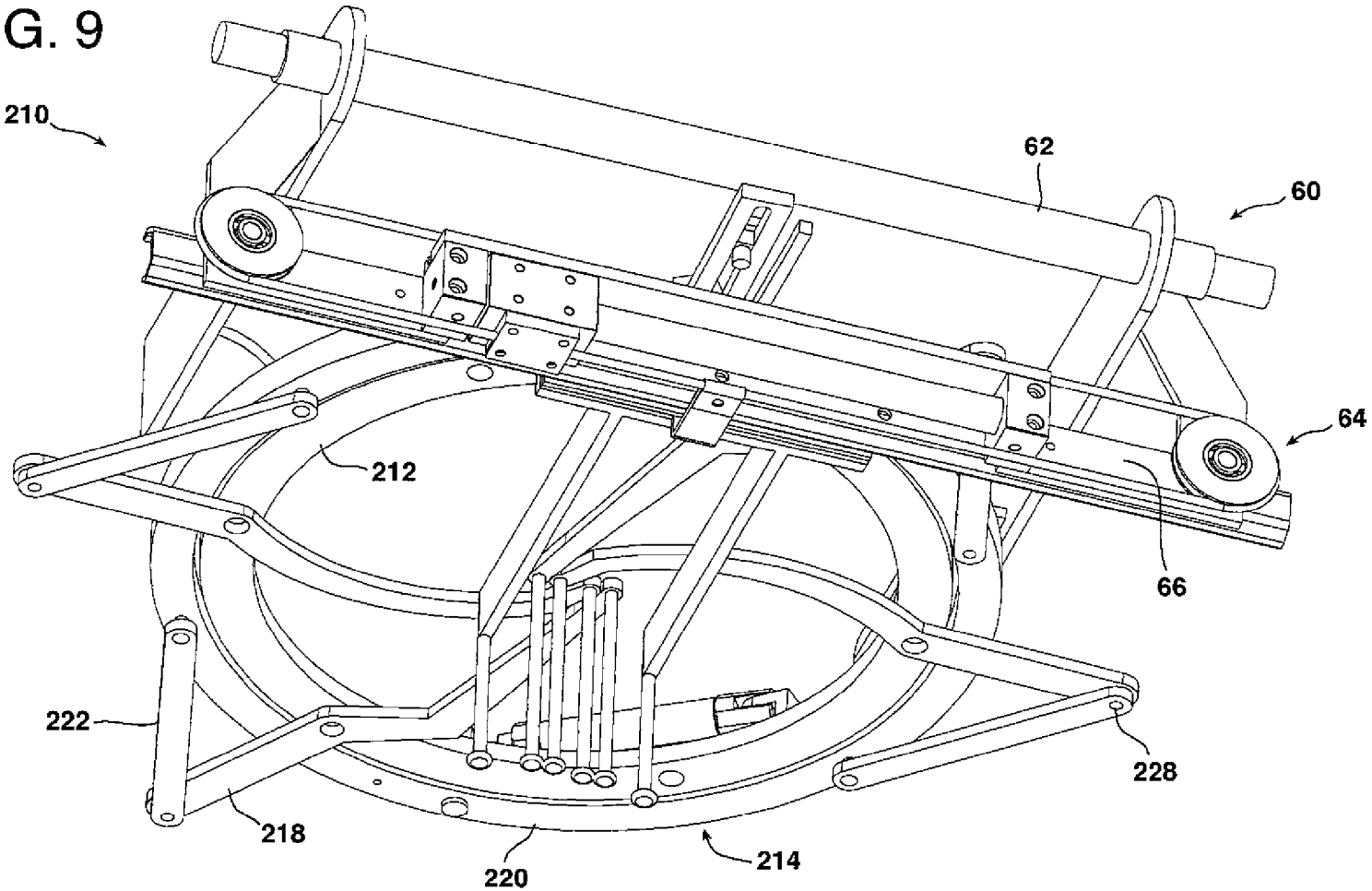
FIG. 9 is a perspective view of an apparatus like that of FIG. 1, but having a four finger configuration, an alternative finger assembly, and further including a mechanism for stretching a bag in a single axis, the mechanism including two stretching fingers.
Figure 10:
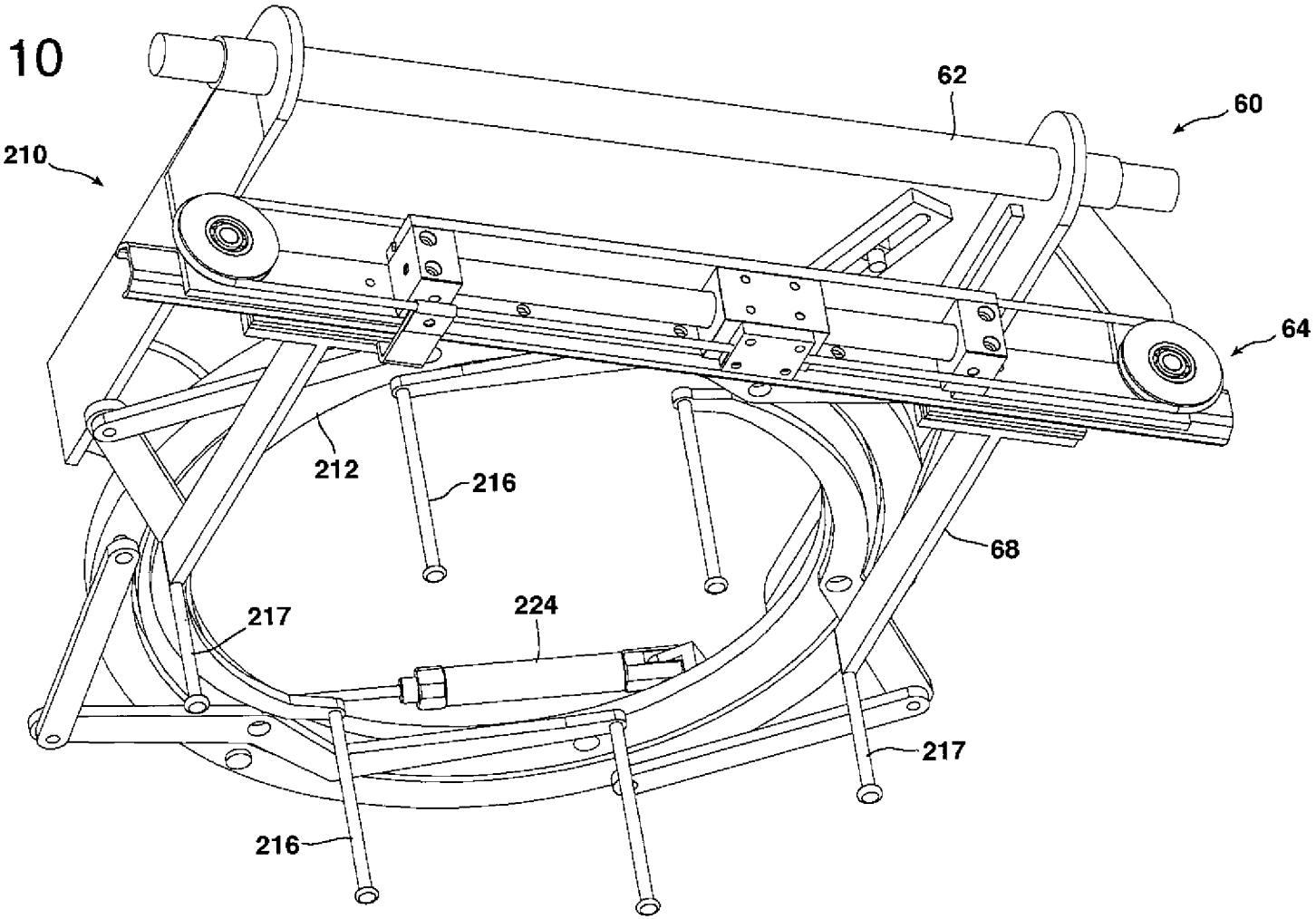
FIG. 10 is a perspective view of the apparatus of FIG. 9, with the plurality of fingers fully spread out from their retracted position.
Figure 11:
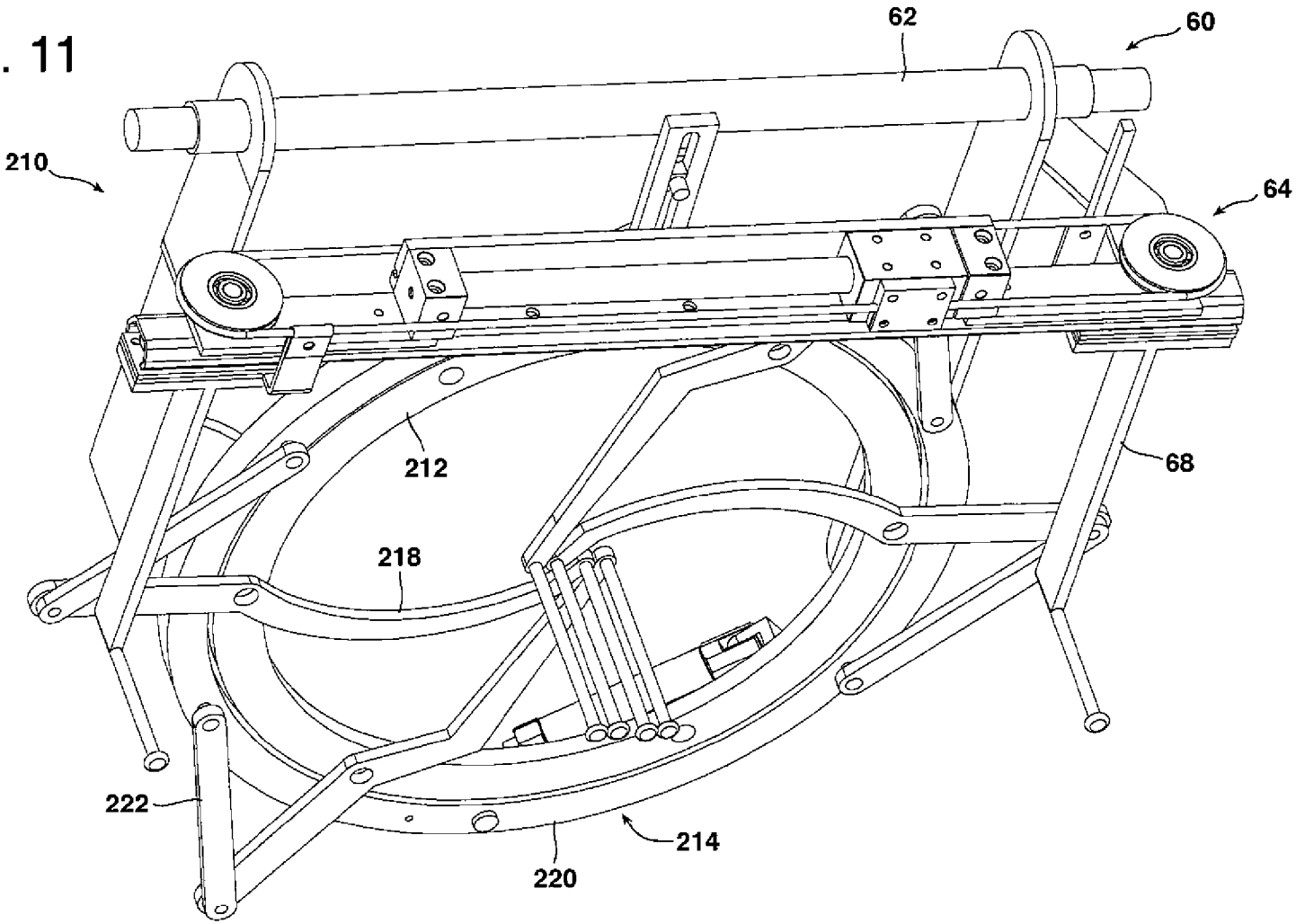
FIG. 11 is a perspective view of the apparatus of FIG. 10, with the plurality of fingers now aligned, wherein a bag is stretched in a single axis by the action of the mechanism for stretching a bag in a single axis.
Figure 12:
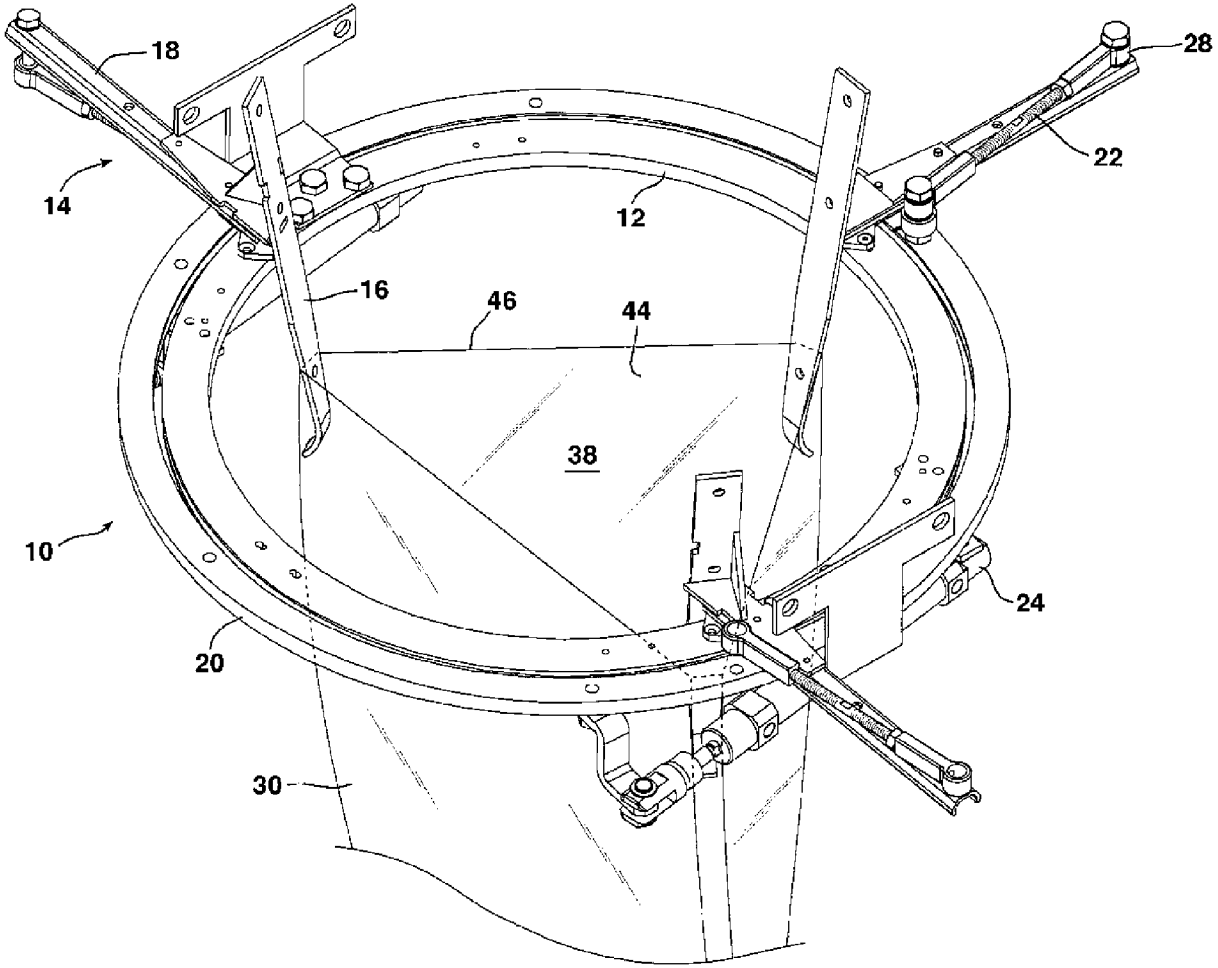
FIG. 12 is a perspective view of an apparatus like that of FIG. 5, but having a three finger configuration.
Figure 13:
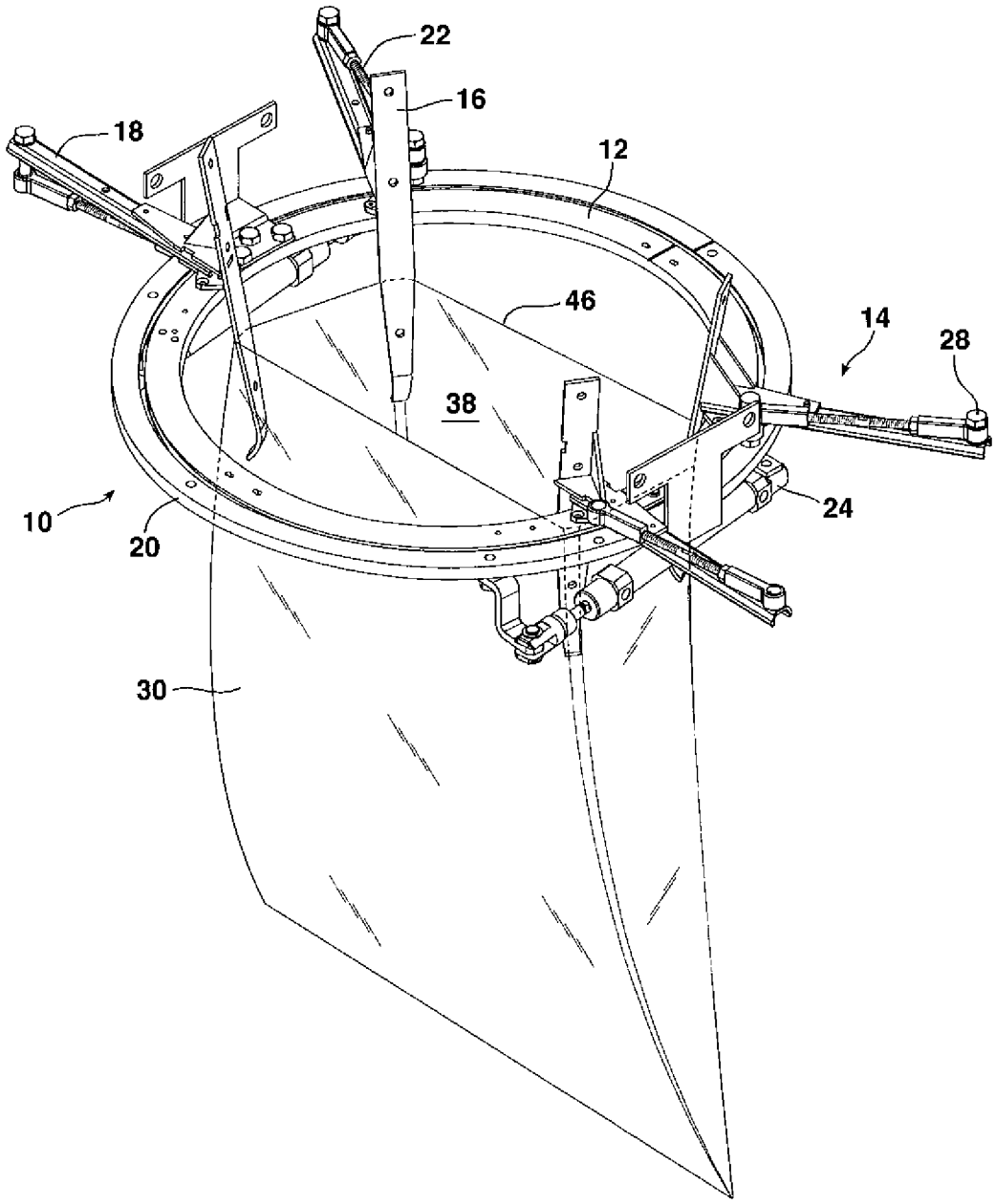
FIG. 13 is a perspective view of an apparatus like that of FIG. 5, but having a four finger configuration.
Figure 14:
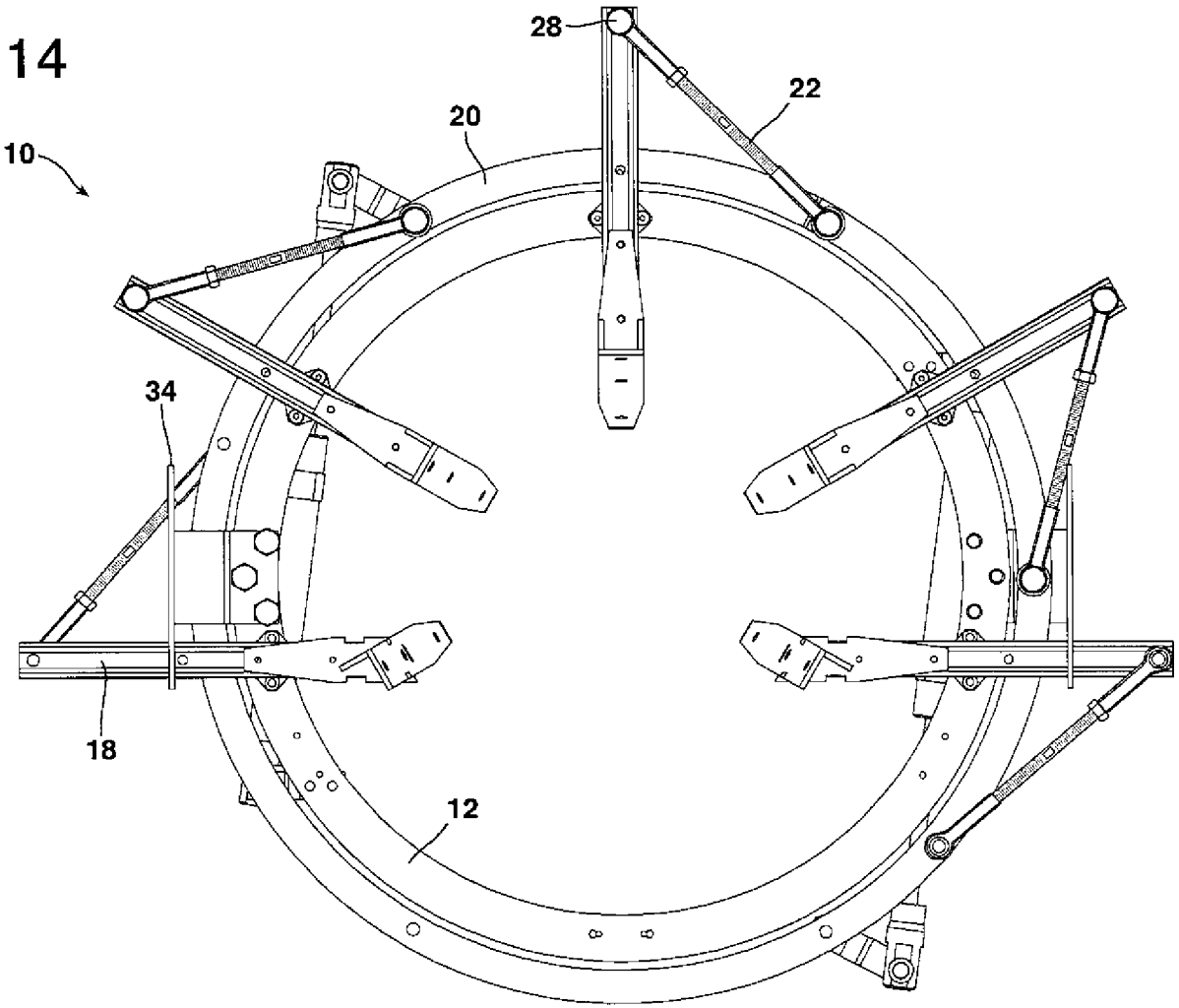
FIG. 14 is a top plan view of an apparatus similar to that of FIG. 3.

The apparatus 210 shown in FIGS. 9 to 11 is similar to that of FIGS. 1 to 5, and 6 to 7, but having a "four+two" finger configuration, and an alternative finger assembly described in more detail below. Thus, apparatus 210 is similar in most respects to apparatus 110 and 10; inner stationary ring 212 is like inner stationary ring 112 and 12; each finger assembly 214 similar in function to finger assembly 114 and 14; finger 216 similar in function to finger 116 and 16; force-transferring member 218 similar in function to force-transferring member 118 and 18; outer rotatable ring 220 like outer rotatable ring 120 and 20; push rod 222 like push rod 122 and 22; and motive device 224 like motive device 124 and 24. Additionally shown are a stretching mechanism 60, support frame 62, pulley mechanism 64, race 66, and finger extension arms 68.

Figure 16:
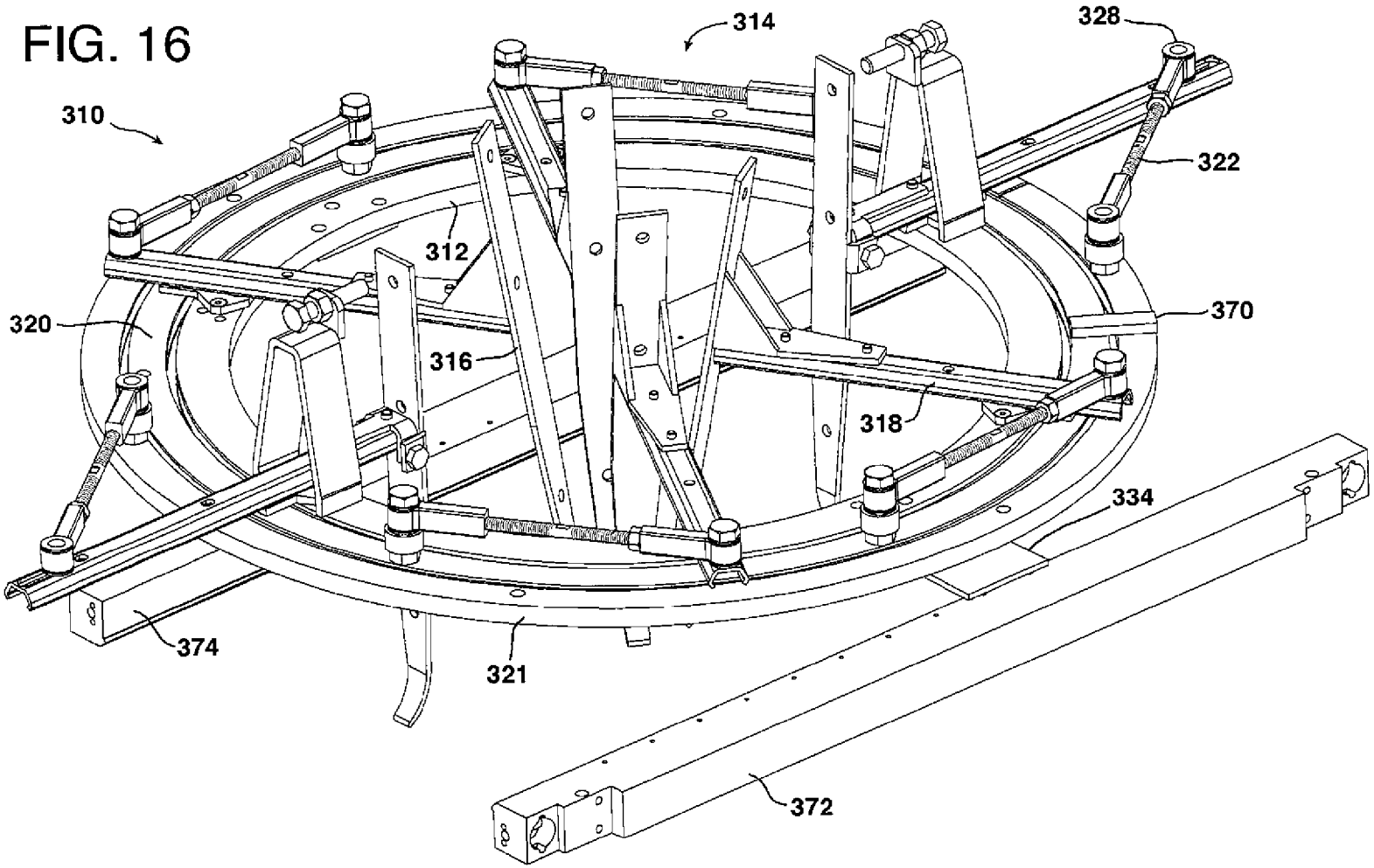
FIG. 16 is a perspective view of an apparatus like that of FIG. 1, but having a six finger configuration, and further including a third concentric ring, and a mechanism for sealing a bag mouth after loading.

The apparatus 310 shown in FIG. 16 is similar in many respects to that of FIGS. 1 to 5, but having a third concentric ring 321, and a sealing mechanism comprising seal bars 372, 374. Thus, inner stationary ring 312 is like inner stationary rings 212, 112 and 12; each finger assembly 314 similar in function to finger assembly 214, 114, and 14; each finger 316 like finger 216, 116 and 16; each force-transferring member 318 similar in function to force-transferring member 218, 118 and 18; outer rotatable ring 320 like outer rotatable ring 220, 120 and 20; push rod 322 like push rod 222, 122 and 22; and motive device 324 like motive device 224, 124 and 24.

Figure 8:
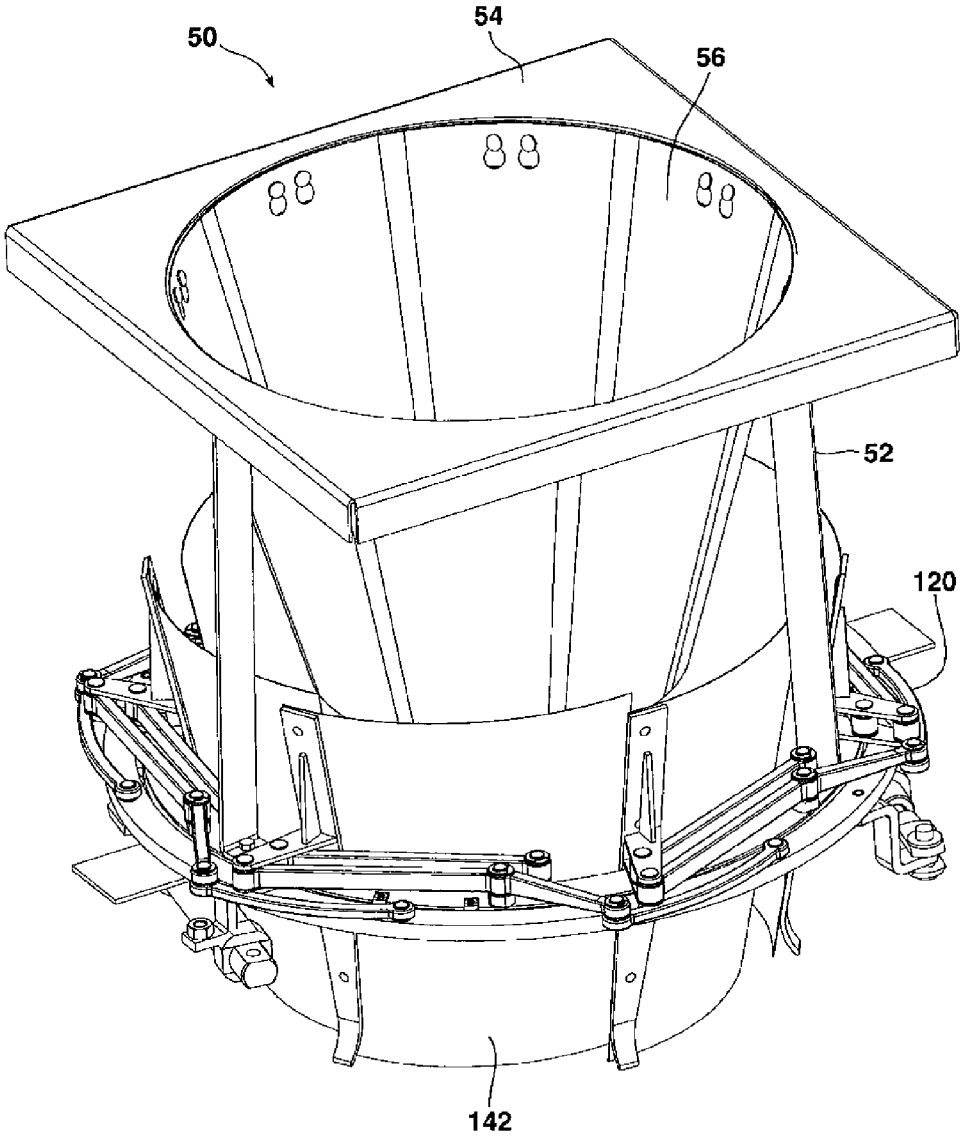
FIG. 8 is a perspective view of an apparatus similar to FIG. 7, and further including a loading funnel disposed above the plane of the inner and outer rings.

FIG. 8 shows an optional loading funnel 50 that can be mounted above or upstream of the plane of the inner stationary ring and outer rotatable ring, the funnel comprising a support structure, in one embodiment comprising a plurality of funnel support brackets 52; a funnel support plate 54; and a plurality of free moving plastic sheets (or a single tubular sheet) comprising a funnel curtain 56, suspended from funnel support plate 54. Funnel 50 enables a product to be guided into an opened bag, and protects the area outside the funnel from fouling by the product. The funnel curtain can be of a unitary, frustoconical construction, or alternatively can be constructed from a number of plastic sheets which can move freely, allowing the passage of large products through the apparatus without impediment.

Figure 17:
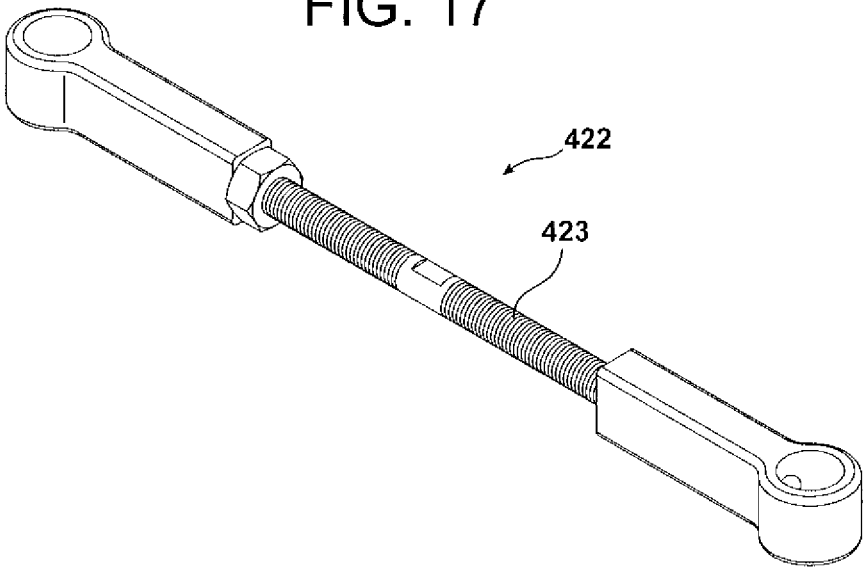
FIG. 17 is a perspective view of a device for selectively and controllably affecting the extent of movement of a finger in a finger assembly.
Figure 18:
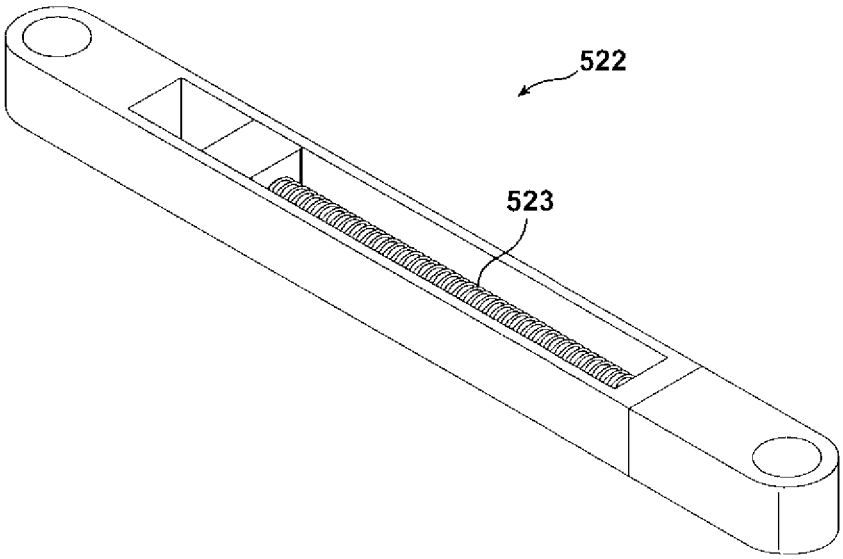
FIG. 18 is a perspective view of an alternative device for selectively and controllably affecting the extent of movement of a finger in a finger assembly.
Figure 19:
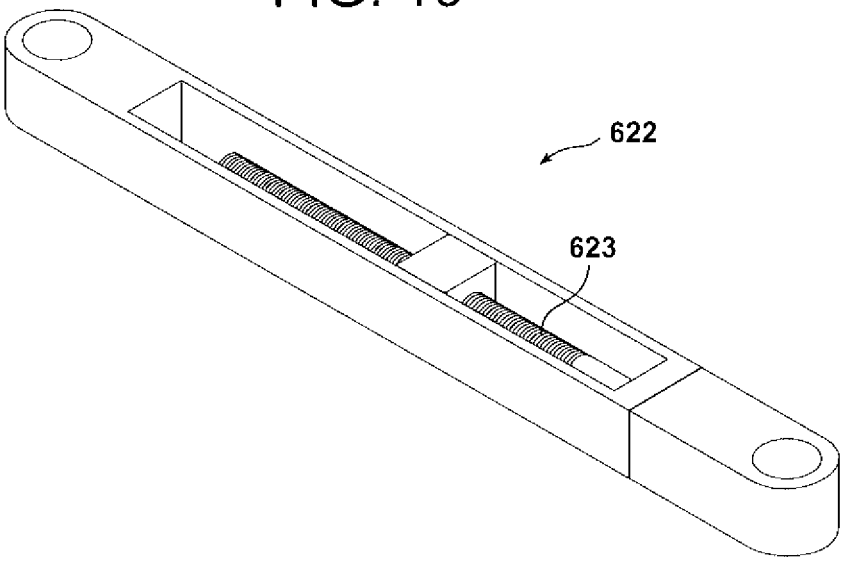
FIG. 19 is a perspective view of another alternative device for selectively and controllably affecting the extent of movement of a finger in a finger assembly.
Figure 20:
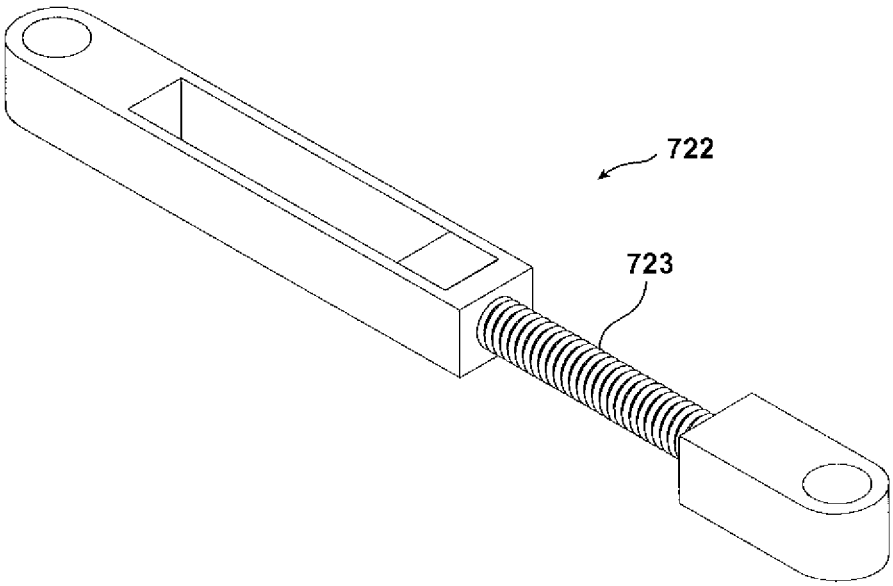
FIG. 20 is a perspective view of another alternative device for selectively and controllably affecting the extent of movement of a finger in a finger assembly.
Figure 29:
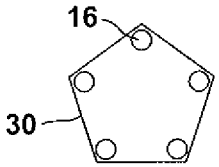
FIG. 29 is a schematic plan view of a bag mouth being held open with five fingers arranged as shown.
Figure 30:
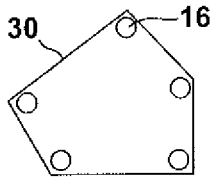
FIG. 30 is a schematic plan view of a bag mouth being held open with five fingers arranged as shown.

FIGS. 17 to 20 show four alternative embodiments of a push rod in accordance with any suitable embodiment of the invention. By introducing adjustable push rods in association with selected respective finger assemblies, many bag mouth shapes can be obtained. FIG. 17 shows an adjustable length push rod 422 having a threaded rod 423. Rod 423 can be adjusted in length prior to operation of apparatus 10, 110, etc. Since the push rod is a link between the force-transferring member and the outer rotatable ring, adjusting the stroke of a given force-transferring member can change the shape of the open bag (i.e. the shape of the bag mouth) from what it would be without such adjustment. Thus, for example, with appropriate use of an adjustable length push rod, a bag mouth shape of a polygon with a skewed shape can be produced (see e.g. FIGS. 29 and 30). FIG. 18 shows a spring-loaded push rod 522 having a tubular spring 523. With the spring loaded link the film tension can be controlled. FIG. 19 shows a maximum-stroke push rod 622 having a threaded rod with stop 623. The maximum stroke link will start to activate the respective finger only after a pre-determined initial stroke length. Relatively small bags would thus not be further opened; larger bags are opened only when the stop has reached the end of the threaded segment. FIG. 20 shows an extendable push rod 722 having a threaded rod 723. Rod 723 can be adjusted in length with respect to the push rod 722 prior to operation of apparatus 10, 110, etc., and this adjustment will effect the geometry of the bag opening.

Optionally, one or more of the plurality of fingers includes a sheet mounting hole 49 (see FIG. 1) or 149 (see FIG. 7) that can accommodate a sheet 142 (FIG. 7). When the fingers each have sheet 142 installed, these sheets will deform during rotation of the outer ring relative to the inner ring, forming a funnel through which a product can be guided or dropped into the bag. Sheets 142 can be used to protect the interior surface of the bag, in the bag mouth area, such that if and when the bag is sealed, the interior surface will have little or no contamination from the product with which it has been loaded. Sheets 142 can optionally be removably attached to respective fingers, so that they can be removed for cleaning or replacement. In one embodiment, as shown in FIG. 7, sheets 142 can be arranged in overlapping fashion, such that the lateral edge of a given sheet overlaps the lateral edge of an adjacent sheet. Sheets 142 can be made from any suitable material, such as plastic, metallic, rubber, etc. as long as they exhibit sufficient toughness and flexibility to operate in conjunction with movement of the finger assemblies, and provide a funnel for guiding product into a bag while protecting the interior surface of the bag. In one embodiment, the sheets can be distributed in an overlapping configuration (see FIG. 7) to facilitate opening and closing of the bag opener.

Fingers 16 can be of any suitable configuration, shape, and length, as long as they can function in combination with the apparatus as described herein, to hold and shape the interior of a bag mouth of a bag in the desired way for purposes of loading the bag mouth with a product. Optionally, the end 36 (see FIG. 3) of one or more of the fingers adapted to hold and shape the interior of a bag mouth can be shaped or curved to facilitate this function.

The force-transferring member 18 can be of any suitable configuration, as long as it translates the rotation movement of the outer ring, into radial movement of the fingers to or away from the central axis of the apparatus (herein the geometric axis running through the diametric centers of the inner and outer rings), as described and shown herein.

In one embodiment, each force-transferring member 18 can comprise a finger arm engaged in a sliding mechanism 39, the sliding mechanism 39 mounted on the inner stationary ring. (see FIGS. 1 to 5, 12, 13, 14, and 16). As shown, the finger arms are each mounted in a sleeve, in turn fixedly mounted on the inner ring 12 at predetermined spaced intervals around the circumference of the ring. The finger arms can slidably move along each respective sleeve, such that when activated, each finger arm can be moved toward or away from the central axis of the apparatus to effect radial movement of the respective fingers. In lieu of a sleeve, any guide or race, either integral with the inner ring at the predetermined spaced intervals, or attached thereto, of any suitable geometry that directs radial movement of the respective finger arm in response to rotation of the outer ring and action of the push rod, can be used. Each finger can be operatively connected to a respective elongate arm 18 by finger support bracket 32.

In a second embodiment, each force-transferring member 18 can comprise a set of parallel bars pivotally mounted on the inner stationary ring 112 (see FIGS. 6, 7, 8, and 15). As shown, the parallel bars are each mounted at a distal end by pivot pins or the like to the inner ring 12 at predetermined spaced intervals around the circumference of the ring. Another set of pivot pins, at the proximal end of the parallel bars, are operatively connected to each respective finger, such that when activated, each set of parallel bars will swing toward or away from the central axis of the apparatus to effect radial movement of the respective fingers.

In a third embodiment, each force-transferring member 18 can comprise an elongate arm pivotally mounted by any suitable means on the inner stationary ring (see FIGS. 10 and 11). As shown, the elongate arms are each pivotally mounted on inner ring 12 at a distal end by pivot pins or the like at predetermined spaced intervals around the circumference of the ring. The proximal end of each elongate arm is operatively connected to each respective finger, such that when activated, each elongate arm will swing toward or away from the central axis of the apparatus to effect radial movement of the respective fingers.

It will be noted that in the second and third embodiments of the force-transferring member 18 discussed above, in some applications (e.g. the shaped openings disclosed in more detail below), the operation of the apparatus may result in rotating the shape of the opening. For example, in the process of further opening the bag mouth to create a half circle, the straight edge of the half circle will rotate as the fingers of the apparatus move from their retracted position. The final rotational position of the straight edge is thus based on the size of the bag. This phenomenon is the result of the fact that the translated movement of the fingers is not totally radial, but has some lateral component as well, because the parallel bars or elongate arms swing through an arc as they move. The mechanism of the first embodiment of the force-transferring member 18 avoids this result by ensuring that the effective movement of the finger arm has virtually no lateral component, but is essentially only radial in nature.

The motive device can be of any appropriate type, such as a pneumatic cylinder, hydraulic cylinder, electromechanical device, mechanical drive initiated by a third device or equipment, or mechanical rack and pinion movement.

Examples and Operation

In FIG. 1, five finger assemblies are shown, each having a finger 16 in a retracted position, i.e. retracted relative to the central axis of the apparatus running orthogonally through the geometric center of the inner and outer rings. Clustering the fingers together in relatively close conformation allows the plurality of fingers to be disposed inside a bag mouth 38 of a bag 30 (see e.g. FIG. 2).

The bag can be presented by any suitable means, such as mechanically, e.g. through the use of suction cups, or manually by a human operator. The bag can be brought up to the fingers such that the cluster of fingers breaks the plane of the bag mouth; or the apparatus can be dropped down toward a bag mouth to produce the same result; or both operations can be done.

Figure 2:
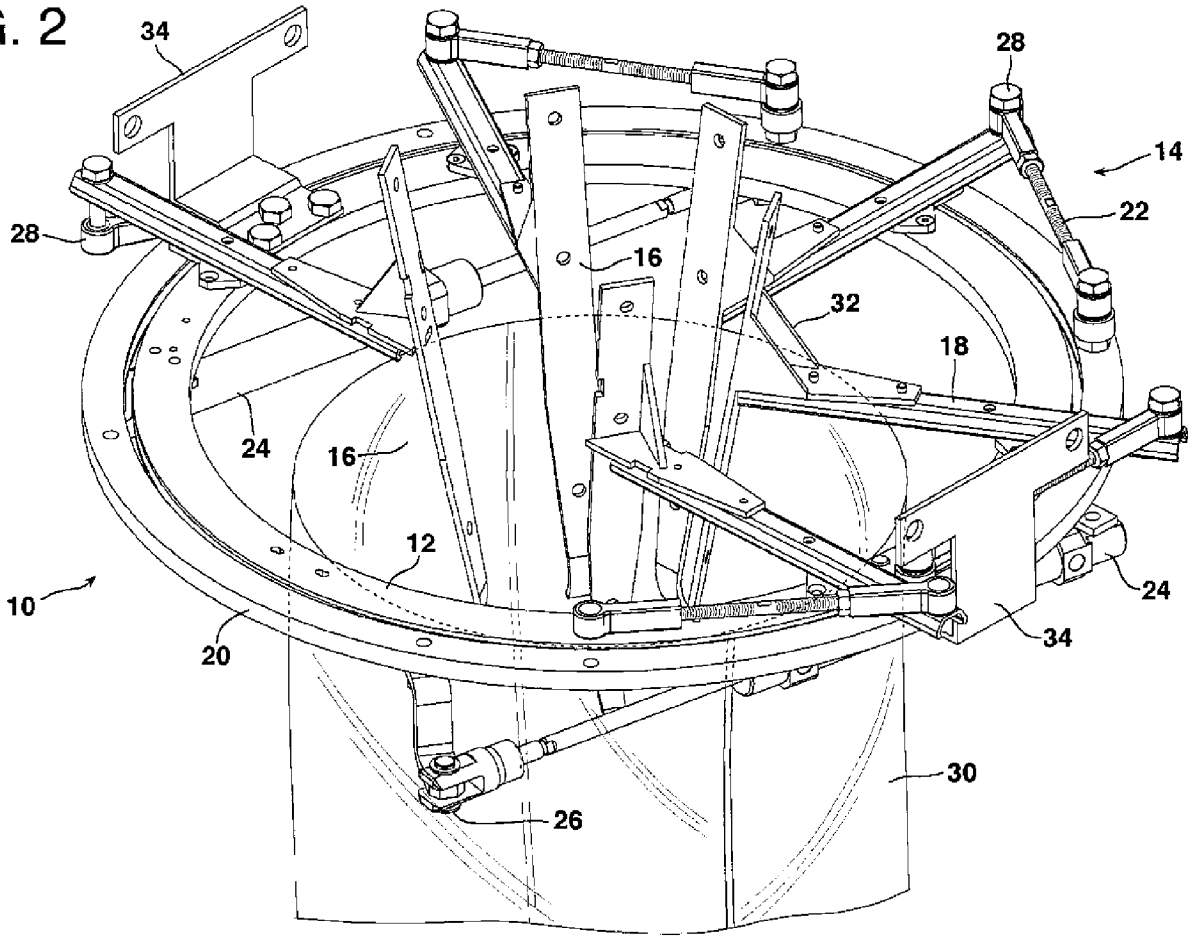
FIG. 2 is a perspective view of the apparatus of FIG. 1, with a bag presented to the apparatus.
Figure 3:
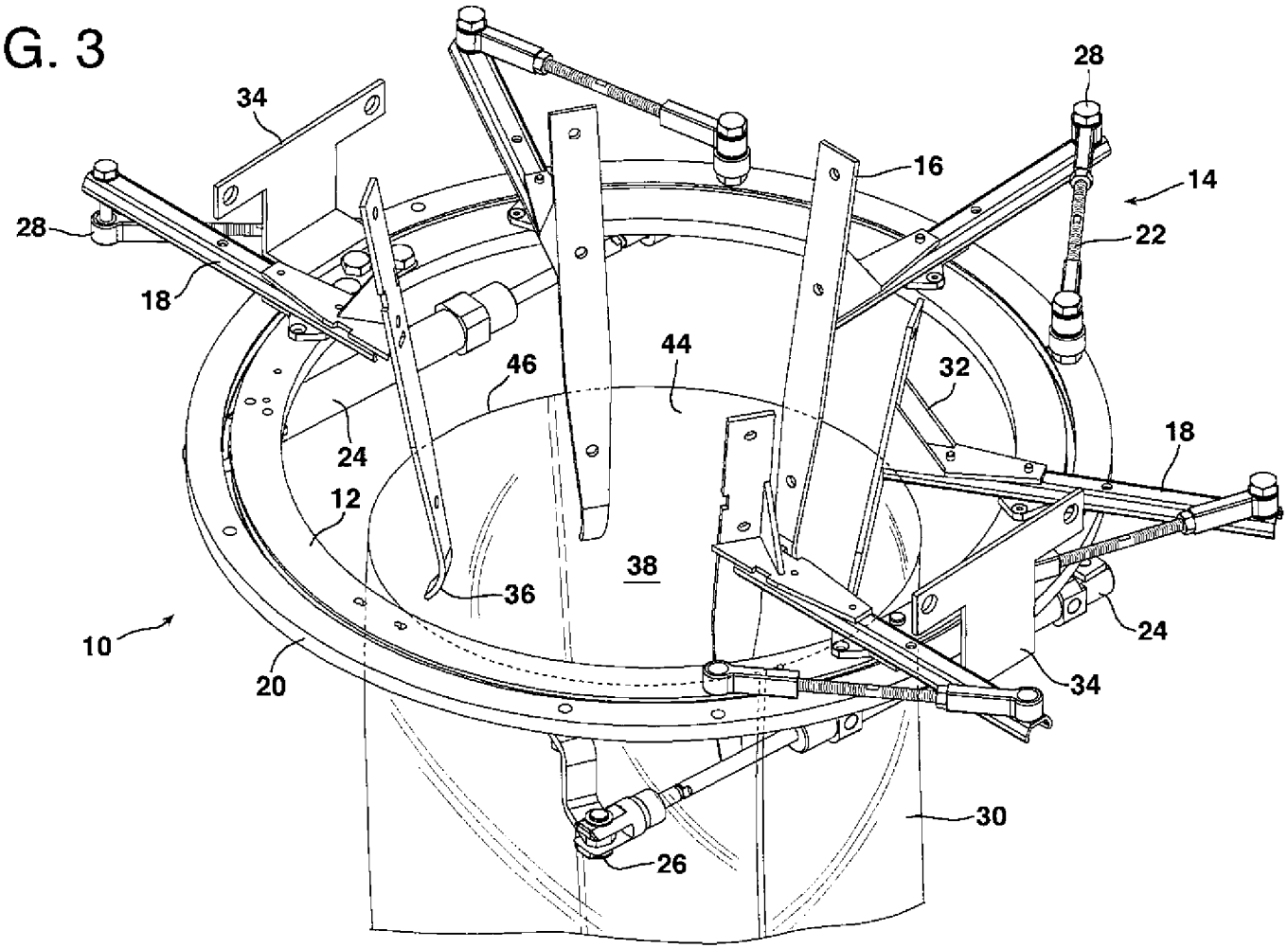
FIG. 3 is a perspective view of the apparatus of FIG. 2, with the plurality of fingers partially spread out from their retracted position.

Motive device 24 is activated to rotate outer ring 20 relative to inner ring 12. This causes movement of push rods 22, which then cause radial movement of each force-transferring member 18, causing fingers 16 to move out radially to engage and hold the interior surface 44 of bag mouth 38. FIGS. 2 through 4 show this progression. The bag in its fully opened, shaped and held condition is shown in FIG. 5. At this point, a product can be inserted or dropped mechanically or manually into the bag. This can be done directly, or using a loading funnel 50 as shown in FIG. 8. Thereafter, the operation of the apparatus can be reversed, to retract the fingers, thereby releasing the loaded bag into a loading box, conveyor, or the like. Optionally, the bag can be sealed at this step, for example as discussed further herein with respect to the embodiment of FIG. 16. Alternatively, the bag can be further processed with the bag mouth in an unsealed state, optionally temporarily closed by e.g. a clip, tack seal, a series of point seals or discontinuous seals to adhere one web to the other until the bag is transferred to e.g. a vacuum sealing operation, or other closing device.

A similar procedure can be followed in accordance with the embodiment of FIGS. 6 and 7, which are analogous to FIGS. 1 and 5, but with a different number of fingers and finger assemblies (six instead of five) and an alternative finger assembly as discussed above.

Figure 23:
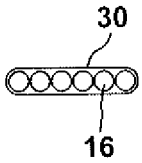
FIG. 23 is a schematic plan view of a bag mouth being held open with a plurality of fingers aligned as in the apparatus of FIG. 9.
Figure 24:
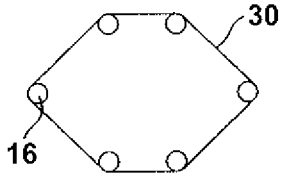
FIG. 24 is a schematic plan view of a bag mouth being held open with a plurality of fingers arranged as in the apparatus of FIG. 10.
Figure 25:
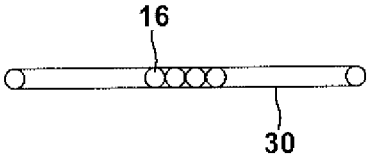
FIG. 25 is a schematic plan view of a bag mouth being held open with a plurality of fingers aligned as in the apparatus of FIG. 11.

FIGS. 9 through 11 show an embodiment of the invention that operates in essentially the same manner as in the previously described embodiment, but additionally including a stretching mechanism 60, including support frame 62, pulley mechanism 64, race 66, and finger extension arms 68. Following the sequence schematically illustrated in FIGS. 23 to 25, the four central fingers 216 are moved radially outward as described with respect to the earlier embodiments. Two stretching fingers 217, mounted on finger extension arms 68, are moved along a single linear axis, in opposite directions, along race 66, by means of pulley mechanism 64. The geometry of the bag mouth with the fingers moved in this manner is shown in FIG. 24. After the bag is loaded with a product, the four fingers 216 are then retracted, and the two stretching fingers are maintained in their position, or separated from one another even further along the single axis, to close the bag as shown in FIG. 25. As with the other embodiments, several options are available and contemplated in accordance with the invention. The loaded bag can be simply released into a loading box, onto a conveyor, or the like. Alternatively, the bag can be sealed at this step. In another alternative, the bag can be further processed with the bag mouth in an unsealed state, optionally temporarily closed by e.g. a clip, tack seal, a series of point seals or discontinuous seals to adhere one web to the other until the bag is transferred to e.g. a vacuum sealing operation, or other closing device.

FIG. 16 shows an embodiment of the invention that operates in essentially the same manner as in the previously described embodiments, but additionally includes a third ring 321, and a sealing mechanism comprising seal bars 372, 374. The third ring 321 is concentric with, and in some embodiments substantially coplanar with, and positioned outside the outer rotatable ring 320.

In one embodiment, the third ring 321 is substantially coplanar with the outer ring 20 and/or the inner ring 12.

Third ring 321 is in some embodiments in communication with outer ring 20 via ball bearings disposed in a race between the respective rings 321 and 20; and/or via a high slip surface where the third ring is in contact with the outer ring, etc.

In operation, third ring 321 initially rotates in synchronization with the outer rotatable ring 320 (as shown, both rings 320 and 321 would initially move in a counterclockwise fashion) so as to effect coordinated radial movement of the fingers relative to the interior surface of the bag, such that the fingers press against the interior surface of the bag with a force sufficient to shape and hold the bag in an open condition. A fixed tab 370 is mounted on the outer rotatable ring 320 that initially synchronises the movement of the outer rotatable ring 320 and third ring 321 when the bag is opened. The outer rotatable ring 320 initially acts as the main action mover, and the third ring 321 as the follower.

Then, after the bag is loaded with a product, the third ring 321 is rotated further (counter-clockwise), while the outer rotatable ring 320 rotates in the reverse direction (i.e. clockwise as depicted) to effect closure of the bag mouth after the bag has been loaded. During this part of the operation, the third ring 321 is the main mover, and the outer rotatable ring 320 the follower. This serves to maintain pressure on the interior surface of the bag mouth so that the bag does not slip or fall away from the fingers.

Seal bar mechanism, having seal bars 372, 374, can then be used to seal the bag mouth closed after the bag has been loaded with a product, by bringing the seal bars together against the exterior surface of the bag mouth. Sealing equipment is well known in the art, and any suitable sealing device can be used to create e.g. a heat seal. An appropriate support can be provided on which to mount the seal bar mechanism.

After this sealing step is completed, third ring 321 rotates in a reverse direction (clockwise as shown), which results in retraction of the two remaining fingers, and release of the loaded and sealed bag.

By pivotally connecting some push rods 322 to the outer rotatable ring 320, and other push rods to the third ring 321, the described bag handling can be achieved. As illustrated in FIG. 16, the push rods that are linked, via push rod linkage 328, to force-transferring members 318 that are positioned at the "2 o'clock" and "8 o'clock" position are pivotally attached to the third ring 321. The remaining four push rods are pivotally attached to the outer rotatable ring 320.

Thus, in operation, all six fingers spread out from their retracted position to shape and hold a bag in an open condition, a product is loaded into the bag (not shown), four of the fingers are then retracted, but the two other fingers operatively connected with the push rods connected to the third ring 321 further stretch the bag as the third ring 321 continues its counter-clockwise rotational movement, resulting in a bag that is stretched between the last two fingers.

At this point, the bag mouth is closed, and it is possible to heat seal the bag at this stage so the shape of the bag is maintained. By applying a low temperature (weak) seal, the bag can be opened at a later stage in a vacuum chamber for further processing, vacuuming and final sealing. If a low vacuum is acceptable, vacuum could be pulled through the fingers of the bag opener before the bag is sealed. This will maintain the shape of the bag over a longer period. Of course, the bag could be sealed with a strong seal, using heat, RF, ultrasonic sealing, or the like.

Figure 36:
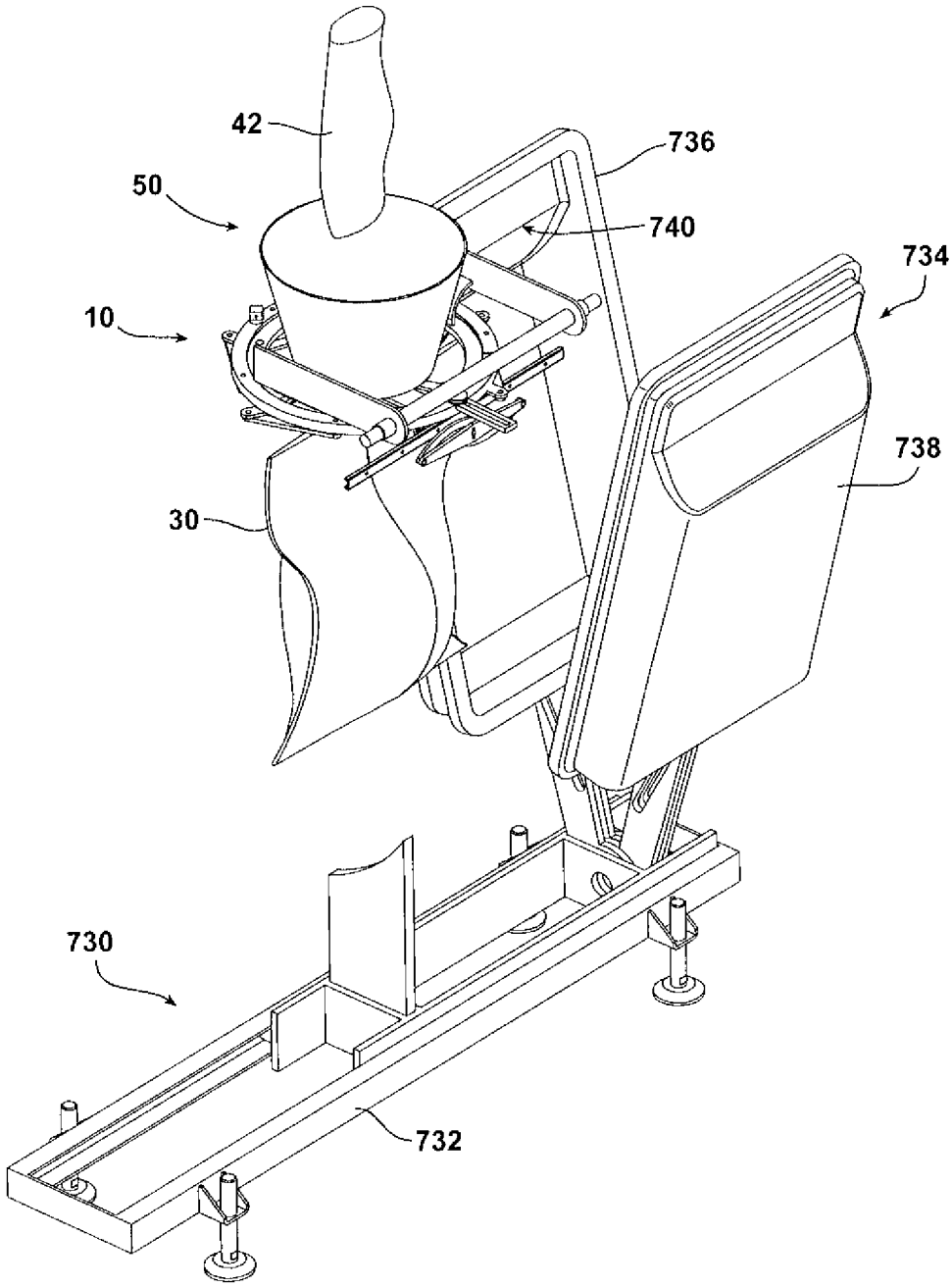
FIG. 36 is a perspective view of an apparatus including a vacuum system.

FIG. 36 shows an alternative embodiment in which a vacuum system having a vacuum chamber with a seal bar is mounted below and adjacent the bag loader. The vacuum system 730 includes a carriage 732. This carriage provides for movement of vacuum chamber 734 from a position adjacent the apparatus 10 to a position underneath the apparatus 10, such that the bag 30, filled with product 42, can be vacuumized; after which the vacuum chamber 734 can be moved back to its position adjacent the apparatus 10. Any suitable arrangement can be mechanically provided for indexing bags 30, vacuum chamber 734, and filled bags 30 in an predetermined sequence. Vacuum chamber 734 includes first enclosure portion 736 and second enclosure portion 738 that can be opened and closed, by suitable motive and control means, to effect vacuumization of a filled bag 30. A sealing device can be installed in either or both of the first and second enclosure portions to seal the vacuumized bag. The filled, vacuumized and sealed bag can be released from the apparatus 10 and conveyed for pack-off on a conveyor or the like. In the embodiment of FIG. 36, the vacuum chamber 734 can move laterally to allow the next product to be loaded while the previous product is being vacuumized.

Figure 21:
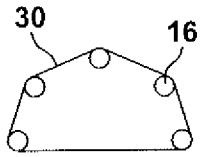
FIG. 21 is a schematic plan view of a bag mouth being held open with a plurality of fingers arranged as in the apparatus of FIG. 5.
Figure 26:
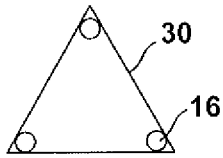
FIG. 26 is a schematic plan view of a bag mouth being held open with a plurality of fingers arranged as in the apparatus of FIG. 12.
Figure 27:
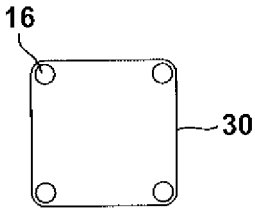
FIG. 27 is a schematic plan view of a bag mouth being held open with four fingers arranged as shown.
Figure 28:
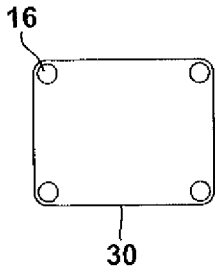
FIG. 28 is a schematic plan view of a bag mouth being held open with four fingers arranged as shown.
Figure 31:
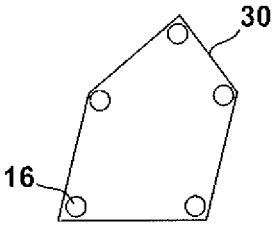
FIG. 31 is a schematic plan view of a bag mouth being held open with five fingers arranged as shown.
Figure 33:
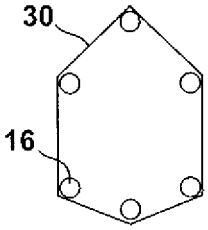
FIG. 33 is a schematic plan view of a bag mouth being held open with six fingers arranged as shown.
Figure 34:
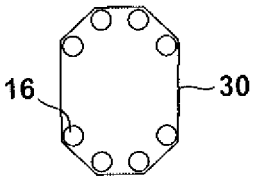
FIG. 34 is a schematic plan view of a bag mouth being held open with eight fingers arranged as shown.
Figure 35:
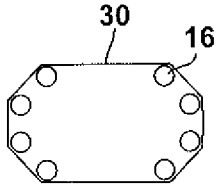
FIG. 35 is a schematic plan view of a bag mouth being held open with eight fingers arranged as shown.

FIGS. 21 to 35 illustrate examples of geometries or shapes of a bag mouth 38 of a opened bag 30 that can be obtained, using a plurality of fingers 16 arranged as shown in each respective figure in accordance with the invention. These include a "D" shape (FIG. 21); circle (FIG. 22); triangle (FIG. 26); square (FIG. 27); rectangle (FIG. 28); symmetric pentagon (FIG. 29); asymmetric pentagon (FIG. 30); skewed pentagon (FIG. 31); hexagon (FIG. 32); asymmetric hexagon (FIG. 33); and elongated octagons (FIGS. 34 and 35).

Figure 22:
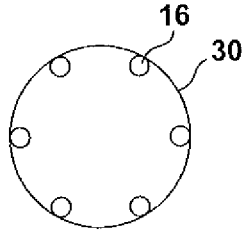
FIG. 22 is a schematic plan view of a bag mouth being held open with a plurality of fingers arranged as in the apparatus of FIG. 7.
Figure 32:
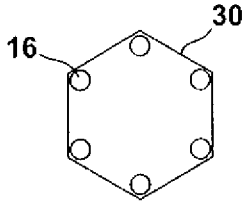
FIG. 32 is a schematic plan view of a bag mouth being held open with six fingers arranged as shown.

It will be noted that e.g. FIGS. 22 and 32 both make use of six fingers that are distributed at substantially equal spacing around the circumference of the apparatus, but result in different bag mouth cross-sections: circular for the bag mouth of FIG. 22, and hexagonal for the bag mouth of FIG. 32. Rounding of the bag mouth to approximate a circular cross-section can be accomplished by the use of overlapping sheets 142 as discussed herein.

Configurability

The apparatus and method of the invention can be configured or adjusted in four ways:

1. the number of fingers/finger assemblies used in a given apparatus.
2. The positional placement of these fingers around the inner and outer rings, controlled by e.g. by the positional placement of the sliding mechanisms around the inner and outer rings.
3. in some embodiments, the angle of the sliding mechanism. The sliding mechanism within which a finger arm is engaged can be positioned perpendicular to the tangent of the outer and rings of the apparatus at the place of attachment, or can be skewed from this position. An example can be seen in FIG. 14, where the sliding mechanism and associated finger arms of the three finger assemblies at the 10:00 o'clock, 12:00 o'clock, and 2:00 o'clock positions are each arranged so that the sliding mechanism within which a finger arm is engaged is positioned perpendicular to the tangent of the outer and rings of the apparatus. In contrast, the sliding mechanism and associated finger arms of the two finger assemblies at the 09:00 o'clock and 3:00 o'clock positions (the two "terminal" sliding mechanisms) are each arranged so that the sliding mechanism within which a finger arm is engaged is positioned at an angle to the outer and rings of the apparatus that is not perpendicular to the tangent of the outer and rings of the apparatus. Those skilled in the art will appreciate, after a review of this disclosure, that by selecting the angle (skew) of the sliding mechanism, the same bag mouth geometry may be achieved as with another angle, but the size of the bag mouth can be varied.
4. in some embodiments, the stroke length of the finger arm of the sliding mechanism. As discussed herein for FIGS. 17 to 20, by introducing adjustable push rods 22 in association with selected respective finger assemblies, the stroke (extent of movement) of a given finger can be limited or controlled, so that many bag mouth shapes can be obtained.

Those of skill in the art will appreciate, after a review of this disclosure, that the configuration features outlined above will also apply mutatis mutandis to alternative force-transferring members, such as a set of parallel bars mounted on the inner stationary ring, or an elongate arm mounted on the inner stationary ring.

Dynamic Adjustment

Figure 37:
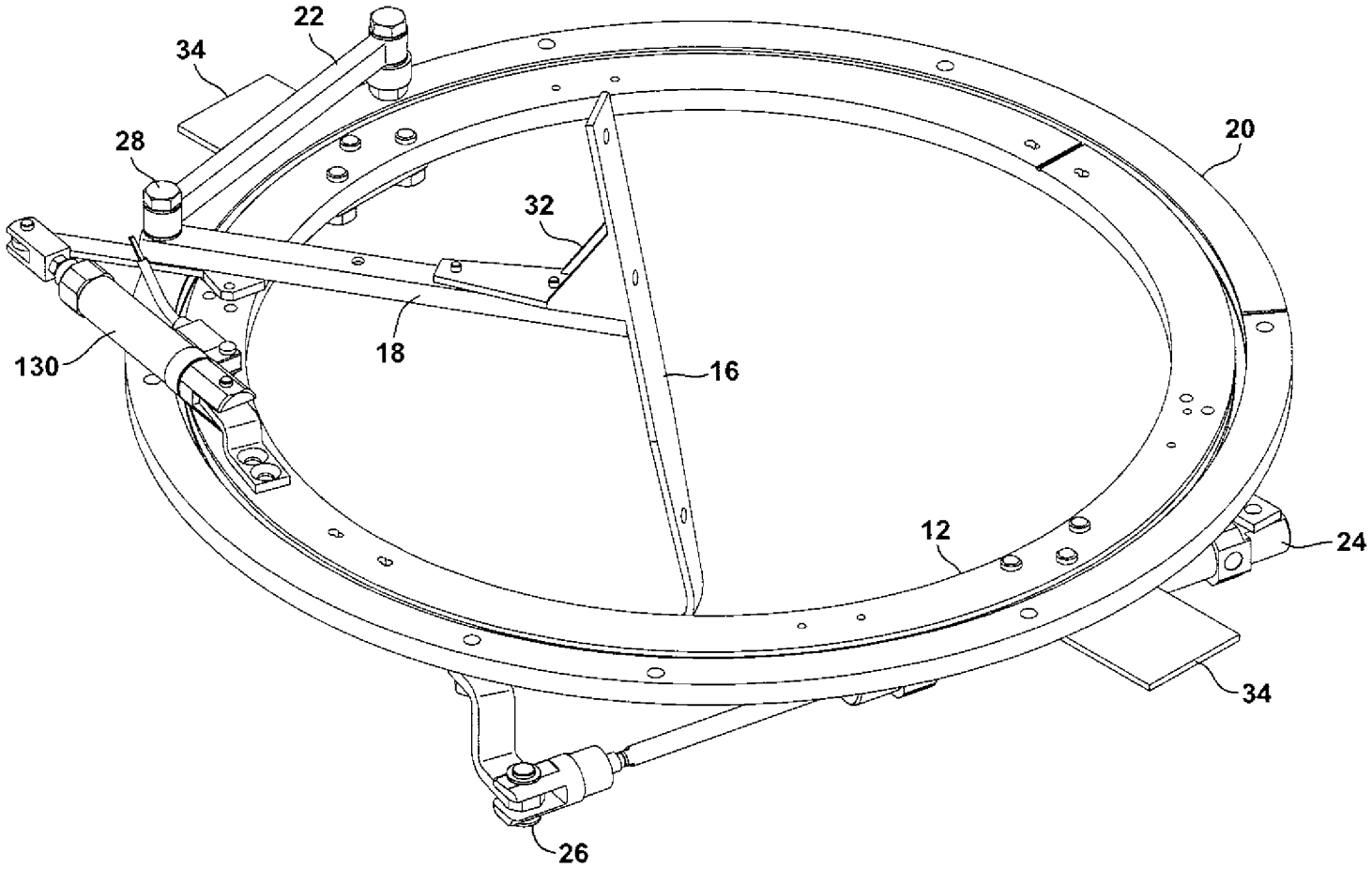
FIG. 37 is a perspective view of a portion of an apparatus including a pivotable sliding mechanism in a retracted configuration.
Figure 38:
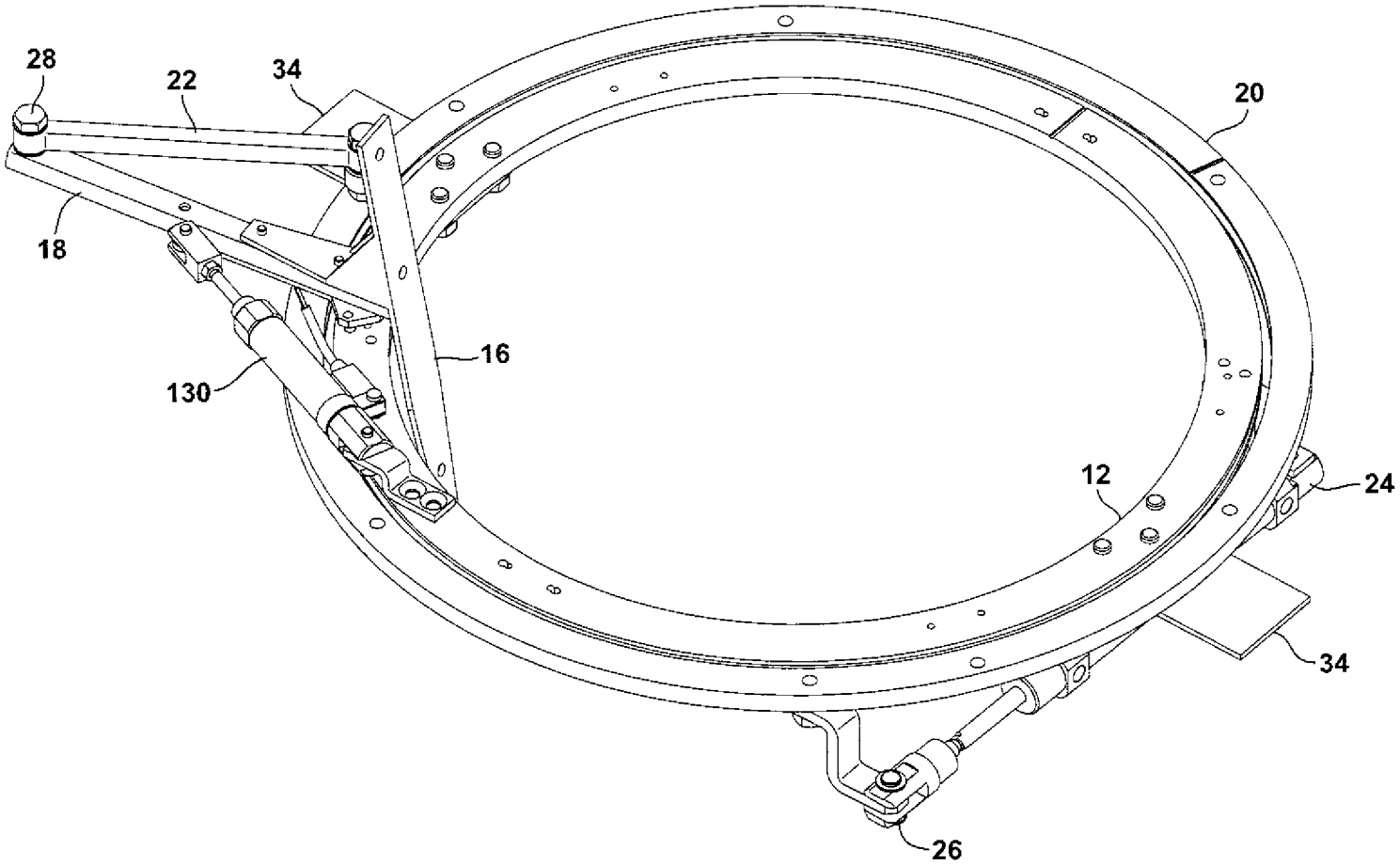
FIG. 38 is a perspective view of the apparatus of FIG. 37, shown in an extended configuration.

FIGS. 37 and 38 show a pivotable sliding mechanism, i.e. the sliding mechanism is not fixed, but has a pivot, controlled by a cylinder. This allows for dynamic control and adjustment of an individual finger assembly, and thus control and adjustment of the final desired bag mouth geometry. The apparatus of FIGS. 37 and 38 is similar in most respects to the embodiments shown in FIGS. 1 to 6, but includes a skew device 130 that can be activated to change the angle at which a pivotable sliding mechanism is positioned on the inner ring 12. FIG. 37 shows the device 130 in a contracted position, with the sliding mechanism at a first orientation. FIG. 38 shows the device 130 at an extended position, with the sliding mechanism at a second orientation. This action can be initiated before or during a single bag opening sequence. The reset position of the finger assembly as a result of this action can be undisturbed for as many bag opening sequences as desired, and then returned to its original orientation, or some other intermediate orientation.

Figure 39:
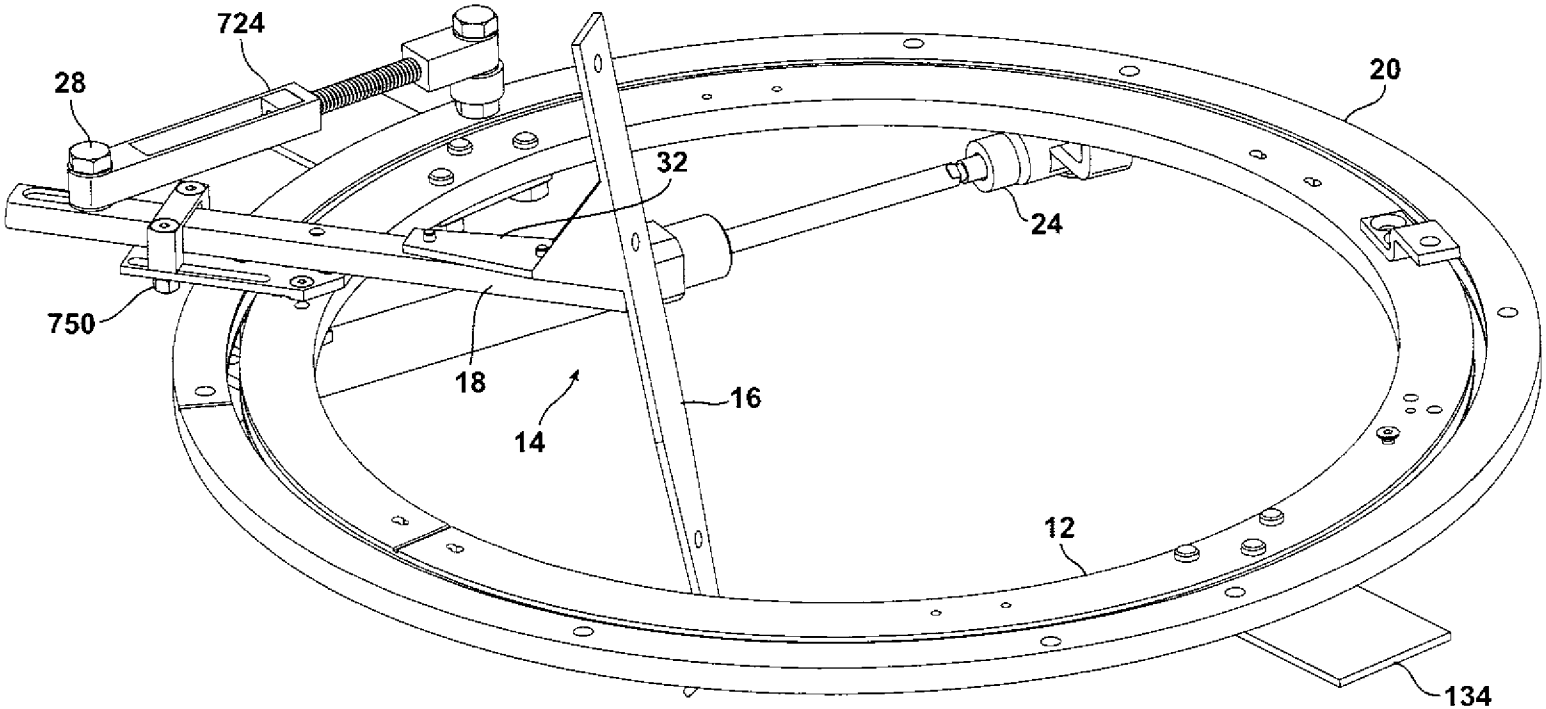
FIG. 39 is a perspective view of a portion of an apparatus including a stroke-limiting mechanism in a retracted configuration.
Figure 40:
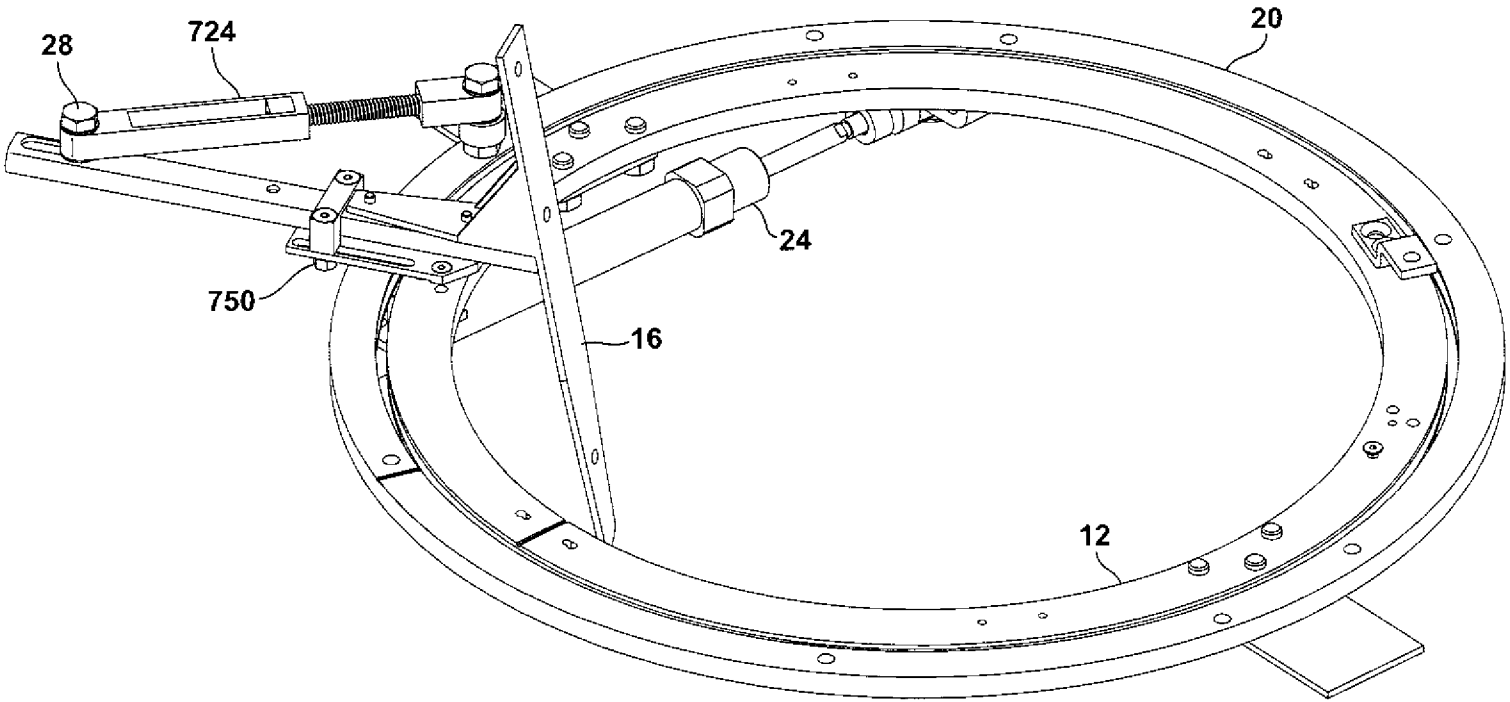
FIG. 40 is a perspective view of the apparatus of FIG. 39, shown in an extended configuration.
Figure 41:
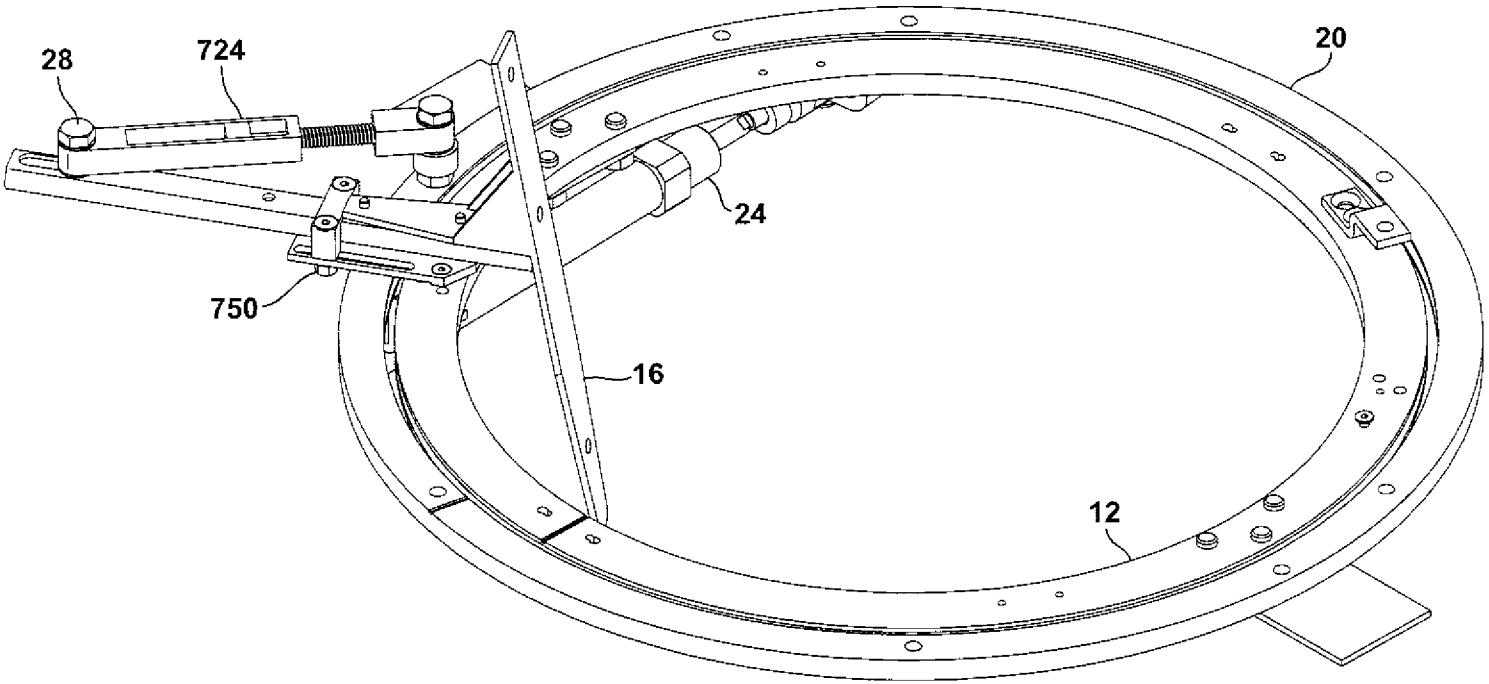
FIG. 41 is a perspective view of the apparatus of FIG. 40, shown with the compression spring push rod in a compressed state.

In another embodiment, FIGS. 39, 40, and 41 illustrate a finger assembly including a dynamic stroke limiter. This comprises a sliding mechanism with a spring loaded push rod, wherein the stroke is limited by a stop. The stop itself is shown as bridging the sliding mechanism, with a race on either side of the sliding mechanism within which the stop can be adjustably positioned mechanically by screws, or by a cylinder or a motorized lead screw (not shown). In FIG. 39, the apparatus is shown with the finger assembly 14 positioned as it would be in the configuration of FIG. 1, with the fingers 16 retracted and clustered near the axial center of the apparatus. Support bracket 32 is shown at some distance from adjustable end stop 750. As the apparatus is operated by rotating outer ring 20, the finger arm 18 of the finger assembly 14 will be moved radially outwardly, the finger 16 contacting and pushing the bag mouth (not shown) outwardly to open the bag. When the finger support bracket 32 reaches the end stop 750, no further outward movement of the finger arm 18 or finger 16 will occur (see FIG. 40). The outer ring 20 may nevertheless continue to rotate to provoke further outward movement of other fingers 16 in the apparatus, in order to reach the desired bag mouth geometry. Since the finger 16 of FIG. 40 can not travel further, because the finger support 32 is abutted against end stop 750, the further rotation of outer ring 20 is taken up by compression of the spring in the compression spring push rod 724 (see FIG. 41). The original position of end stop 750, the length of finger arm, and the length of the push rod and the spring are all predetermined based on the anticipated size of the bags to be opened, and the bag opening geometries to be attained. In one embodiment, finger 16, and another finger (not shown) radially opposite on the apparatus, can be used to define a flat side of a bag opening, for example the straight line segment in a D-shaped opening (see e.g. the upper left and lower right fingers 16 in FIG. 5). One or more than one stroke-limiting finger assemblies 14 can be used at a given time in an apparatus in accordance with the invention to achieve the desired bag opening geometry. Such an apparatus can be adjusted from time to time as desired to adjust the location of the end stops 750 on selected finger assemblies 14, or remove one or more end-stops 750 altogether. Adjustable push rods can likewise be adjusted to increase or decrease spring tension (if spring loaded), or be otherwise adjusted as needed. If a cylinder, like the skew device 130 of FIGS. 37 and 38, is used to control the position of adjustable end stop 750, then dynamic adjustment of the stroke of the particular finger assembly can be done before or during a single bag opening cycle.

Figure 42:
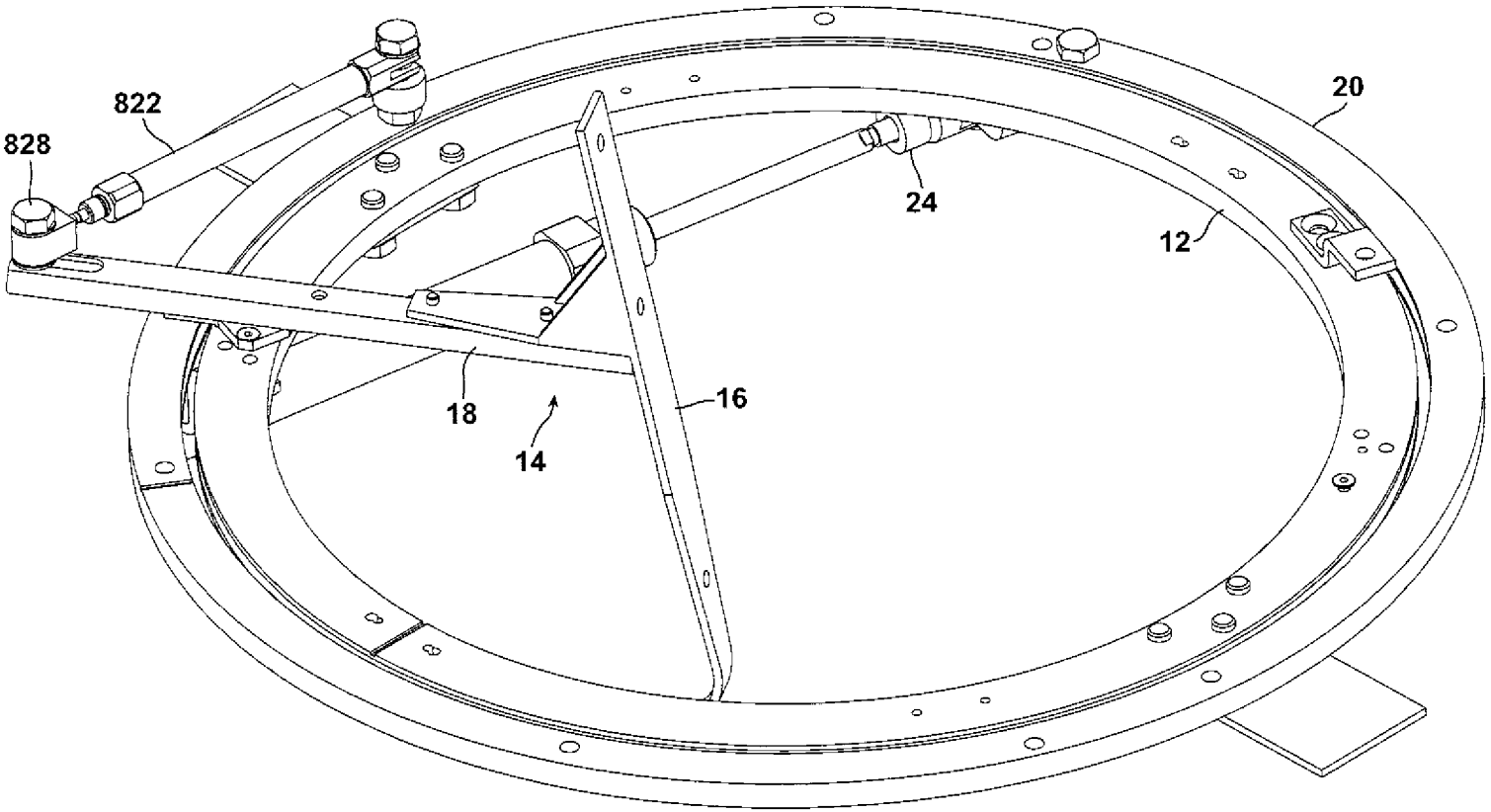
FIG. 42 is a perspective view of a portion of an apparatus with a dynamically deactivatable finger assembly in an initial position.
Figure 43:
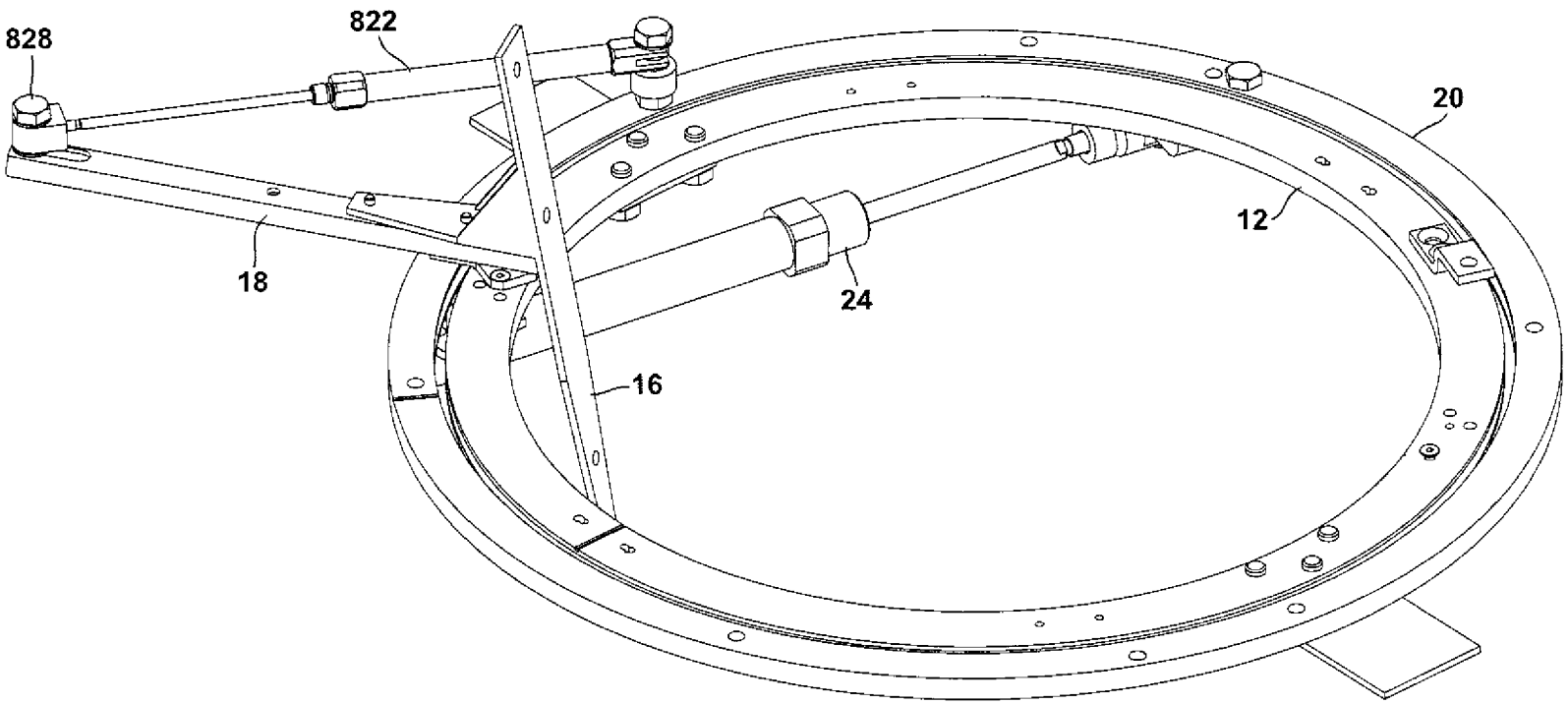
FIG. 43 is a perspective view of the apparatus of FIG. 42, with the dynamically deactivatable finger assembly in a second deactivated position.
Figure 44:
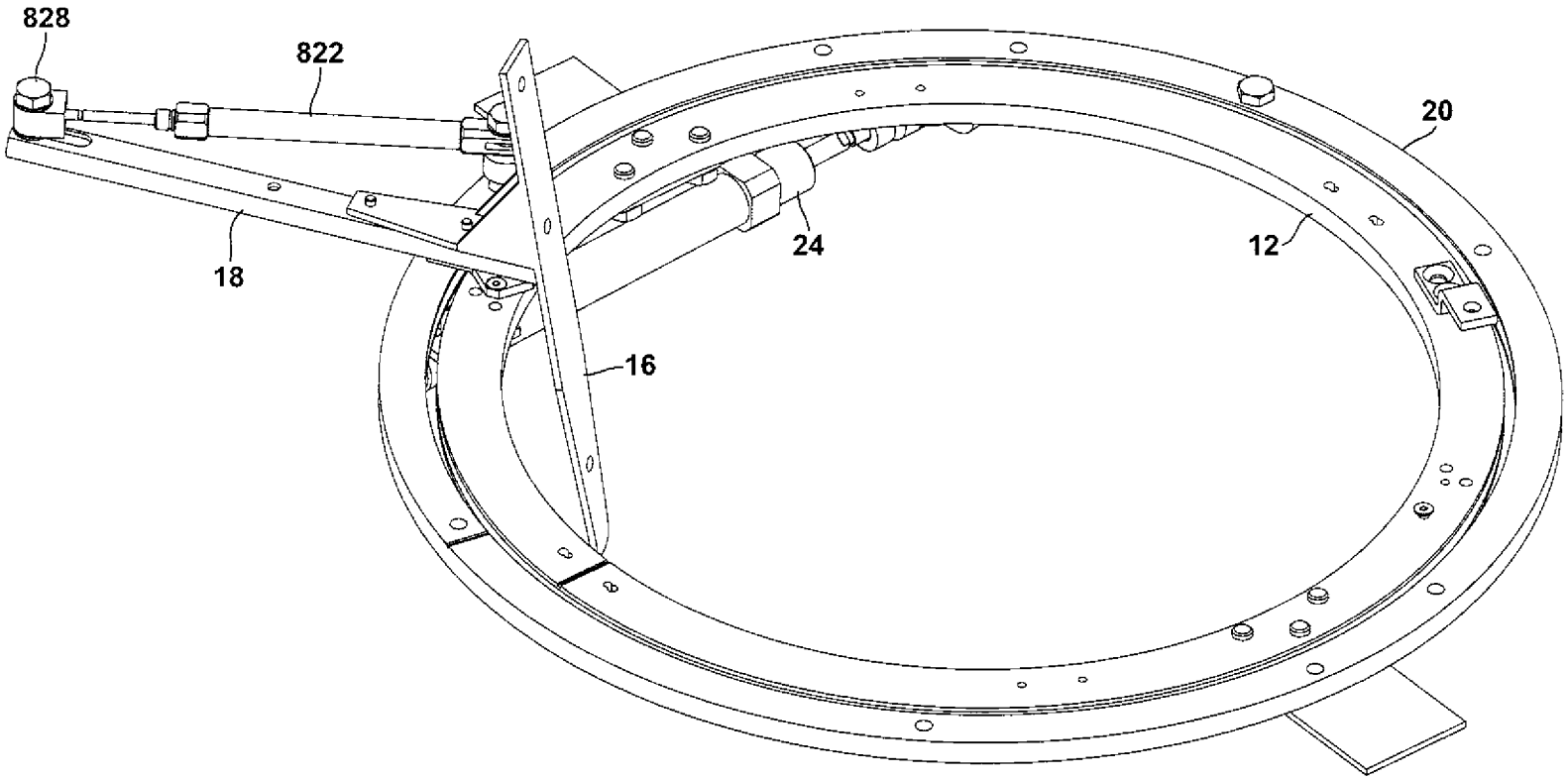
FIG. 44 is a perspective view of the apparatus of FIG. 42, with the outer ring of the apparatus rotated to effect bag opening.

In another embodiment, FIGS. 42, 43, and 44 illustrate a portion of the apparatus with a dynamically deactivatable finger assembly in an initial position. "Dynamically deactivatable" herein means that at least one of the plurality of finger assemblies of an apparatus is configured to be deactivated, that is, to be placed in a position where the respective finger is not involved in a given bag loading cycle; and this feature or function is achieved by withdrawing the finger from the remaining fingers, by any suitable mechanical or automated method or control system, so that when a bag opening is introduced to the remaining fingers of the apparatus, and the apparatus is activated to further open and hold a bag, the withdrawn finger does not engage the interior surface of the bag, and thus does not participate in the opening process. The advantage of this embodiment is that a given number of finger assemblies can be initially installed in the apparatus, with one or more of these assemblies being dynamically deactivatable; and that depending on the desired bag opening geometry, one or more of these finger assemblies can be deactivated before a bag opening cycle. For a single bag opening cycle, or a series of bag opening cycles, a given one or more of the dynamically deactivatable finger assemblies can be deactivated, i.e. the respective finger or fingers can be withdrawn prior to a given bag opening cycle or cycles such that the respective finger or fingers do not engage the interior surface of the bag mouth and therefore do not participate in the bag opening process. Dynamically selecting one or more deactivatable fingers for each sequence allows the bag opening geometry to be changed or adjusted "on the fly", without the need for a change of hardware components or significant down-time while the apparatus is being mechanically reconfigured. Thus, by way of example, one of six finger assemblies in a given apparatus can be a dynamically deactivatable finger assembly. By way of illustration, for a sequence of one or more bag opening cycles, the dynamically deactivatable finger assembly can be deactivated. For this sequence then, the respective finger does not engage the bag mouth during each opening cycle, and the movement of the remaining fingers will determine the bag mouth geometry. For a subsequent one or more bag opening cycles, if a change in bag mouth geometry is desired, the dynamically deactivatable finger assembly can be reactivated by a suitable control system or the like. For this sequence then, the respective finger engages the bag mouth during each opening cycle, and the movement of all six fingers will determine the bag mouth geometry.

FIG. 42 shows a portion of an apparatus in accordance with the invention wherein a finger assembly 14 is dynamically deactivatable. For the sake of clarity, other finger assemblies 14 are not shown, but in practice would be positioned appropriately around the apparatus as shown in other drawings of this disclosure. These additional finger assemblies can be of any of the embodiments disclosed herein, and optionally one or more of these additional assemblies can also be dynamically deactivatable. In FIG. 42, the finger assembly 14 is positioned as it would be in the configuration of FIG. 1, with the fingers 16 retracted and clustered near the axial center of the apparatus. If for a given bag opening sequence, it is determined to deactivate this finger, a deactivation device 822, such as a pneumatic cylinder mounted on outer ring 20, is operated to withdraw finger 16 from the remaining cluster of fingers 16 by moving finger arm 18 radially outwardly along the sliding mechanism (see FIG. 43), such that the finger 16 is radially adjacent inner ring 12. It will be noted that this operation occurs without the rotation of outer ring 20, and the remaining fingers are therefore not moved prematurely.

As the apparatus is further operated in a typical bag opening cycle as disclosed herein, outer ring 20 is rotated (counterclockwise in FIG. 44), and the remaining fingers of the apparatus engage the interior surface of the bag opening, further opening and shaping the bag opening. Since the finger 16 of FIG. 42 is abutted against the radially inner side of inner ring 12 during this step, it can not travel radially outward any further. The force exerted on finger arm 18 at linkage 828 is taken up by compression of cylinder 822 (see FIG. 44).

The various components described herein can be made of any suitable materials, including metal and plastic. An example of use of the apparatus of the invention is in a meat packing plant, where a primal or subprimal of fresh red meat, poultry, pork, etc. can be packaged in a bag opened and held by the apparatus. For such applications, materials such as stainless steel are in general suitable for the components of the apparatus that will come into contact with or be near a food product. Such components would include, e.g. the fingers 16, and inner and outer rings 12 and 20.

The apparatus and method can be used in connection with the packaging of any food or non-food product.

Although the apparatus and method are shown in embodiments where a product can be loaded vertically into a bag, e.g. by dropping the product vertically into the bag, those skilled in the art will appreciate, after a review of the present disclosure, that the apparatus can be oriented, and the method can be practiced, in any suitable orientation. Thus, although the invention is described illustratively with the apparatus in an essentially horizontal position, i.e. the inner and outer rings are disposed in a substantially horizontal plane, and the plurality of fingers are in a substantially vertical position, the apparatus can be configured in any suitable orientation. For example, the inner and outer rings can be disposed in a substantially vertical plane, and the plurality of fingers can be disposed in a substantially horizontal position. Any position of the plane of the inner and outer rings of the apparatus between the horizontal and vertical orientation, with suitable orientation of the other components of the apparatus, can also be used, and are contemplated by the present invention. For horizontal loading of products, one side of the bag need to be flat and horizontal at all times regardless of the bag size, and two of the fingers are always moving in opposites direction from each other along a single axis. In the horizontal configuration, the opening will thus have at least one "flat side", which becomes the reference plane for loading. In this embodiment, the fingers that define the straight edge should move in opposite directions (i.e. with no downward or upward travel) during the bag opening process so that the reference plane for the loader is stationary.

The invention can be beneficially used with any suitable type of bag, including patch bags, bags without patches, taped bags, serrated bags, and bags made from film tubing. Taped bags are exemplified in U.S. Pat. No. 3,587,143 (Wing), U.S. Pat. No. 5,826,405 (Killinger et al.) and U.S. Pat. No. 6,282,871 (Killinger et al.), and involve the indexing of imbricated bags, by a pair of attached tapes, out of a box of such bags, and toward a location where the bags can be mechanically and/or manually opened and loaded; serrated bags are described in US 2009/0023569 (Frost et al.), where a bag handling apparatus is disclosed; bags made from film tubing are described in US 2006/0059868 (Melville); these references all incorporated herein by reference in their entirety. Any films, especially thermoplastic films such as olefinic films with or without oxygen barrier functionality, can be used with benefit in making or providing bags, including patch bags, in connection with the invention. These films are made by extrusion coating, coextrusion, lamination, or other suitable processes. In one embodiment, films comprise an outer layer, an intermediate layer, and an inner layer. The materials of the outer layer are often chosen for abuse resistance and/or sealability, and can be chosen from any suitable polymeric materials such as polyolefins, such as ethylenic polymers and copolymers, poly-propylene, polyesters, polyamides, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Suitable materials include polyvinylidene chloride polymers and copolymers, ethylene vinyl alcohol copolymer, polyvinyl alcohol, polyamide, polyester, acrylonitrile, and the like. Bags can optionally be heat shrinkable, and can be at least partially crosslinked.

It is to be understood that variations of the present invention can be made without departing from the scope of the invention, which is not limited to the specific embodiments and examples disclosed herein, but extends to the claims presented below.

What is claimed is:

1. An apparatus for shaping and holding a bag in an open condition, and holding the bag in the shaped, open condition during loading of the bag with a product, wherein the bag comprises a bag mouth having an interior and exterior surface, comprising:

a) an inner stationary ring;

b) a plurality of finger assemblies, each finger assembly comprising i) a finger, the finger adapted to press against the interior of the bag mouth; and ii) a force-transferring member to which the finger is operatively connected, the force-transferring member comprising an elongate arm mounted on the inner stationary ring;

c) an outer rotatable ring, the outer rotatable ring being concentric with the inner stationary ring;

d) a push rod operatively connected to each respective finger assembly; and e) a motive device adapted to cause rotation of the outer rotatable ring relative to the inner stationary ring to effect coordinated radial movement of the fingers relative to the interior surface of the bag;

wherein the force-transferring member comprises a finger arm engaged in a sliding mechanism, the sliding mechanism mounted on the inner stationary ring.

2. The apparatus of claim 1 wherein the push rod is operatively connected to each respective finger assembly through a linking rod to a respective elongate arm.

3. The apparatus of claim 1 wherein the push rod is operatively connected to each respective finger assembly through a respective finger arm.

4. The apparatus of claim 1 wherein a loading funnel disposed above or upstream of the plane of the inner stationary ring and outer rotatable ring, the funnel comprising a plurality of free moving plastic sheets.

5. The apparatus of claim 1 wherein at least one of the plurality of finger assemblies can be adjusted so as to alter a predetermined shape of the bag mouth.

6. A method of shaping and holding a bag in an open condition, and holding the bag in the shaped, open condition during loading of the bag with a product, comprises a) providing a partially open bag, wherein the bag comprises a bag mouth having an interior and exterior surface;

b) providing an apparatus comprising i) an inner stationary ring;

ii) a plurality of finger assemblies, each finger assembly comprising a finger, the finger adapted to press against the interior of the bag mouth, and a force-transferring member to which the finger is operatively connected, the force-transferring member comprising an elongate arm mounted on the inner stationary ring;

iii) an outer rotatable ring, the outer rotatable ring being concentric with the inner stationary ring;

iv) a push rod operatively connected to each respective finger assembly; and v) a motive device adapted to cause rotation of the outer rotatable ring relative to the inner stationary ring to effect coordinated radial movement of the fingers relative to the interior surface of the bag;

c) moving the partially open bag relative to each finger such that each finger is inserted into the bag mouth of the partially open bag;

d) activating the motive device to cause rotation of the outer rotatable ring relative to the inner stationary ring, and to effect coordinated radial movement of the fingers relative to the interior surface of the bag, such that the fingers press against the interior surface of the bag with a force sufficient to shape and hold the bag; and e) loading the bag with a product wherein the force-transferring member comprises a finger arm engaged in a sliding mechanism, the sliding mechanism mounted on the inner stationary ring.

7. The method of claim 6 wherein the push rod is operatively connected to each respective finger assembly through a linking rod to a respective elongate arm.

8. The method of claim 6 wherein the push rod is operatively connected to each respective finger assembly through a respective finger arm.

9. The method of claim 6 wherein a loading funnel disposed above or upstream of the plane of the inner stationary ring and outer rotatable ring, the funnel comprising a plurality of free moving plastic sheets.

10. The method of claim 6 comprising adjusting at least one of the plurality of finger assemblies so as to alter a predetermined shape of the bag mouth.

11. An apparatus for shaping and holding a bag in an open condition, and holding the bag in the shaped, open condition during loading of the bag with a product, wherein the bag comprises a bag mouth having an interior and exterior surface, comprising:

a) an inner stationary ring;

b) a plurality of finger assemblies, each finger assembly comprising i) a finger, the finger adapted to press against the interior of the bag mouth; and ii) a force-transferring member to which the finger is operatively connected, the force-transferring member comprising an elongate arm mounted on the inner stationary ring;

c) an outer rotatable ring, the outer rotatable ring being concentric with the inner stationary ring;

d) a push rod operatively connected to each respective finger assembly; and e) a motive device adapted to cause rotation of the outer rotatable ring relative to the inner stationary ring to effect coordinated radial movement of the fingers relative to the interior surface of the bag;

wherein the apparatus further comprises a third ring, the third ring being concentric with the outer rotatable ring; the third ring adapted to rotate with the outer rotatable ring to effect further opening of the bag mouth, and then rotate further, while the outer rotatable ring reverses direction, to effect closure of the bag mouth after the bag has been loaded with a product, in preparation for sealing of the bag mouth.

12. The apparatus of claim 11 wherein the push rod is operatively connected to each respective finger assembly through a linking rod to a respective elongate arm.

13. The apparatus of claim 11 wherein the push rod is operatively connected to each respective finger assembly through a respective finger arm.

14. The apparatus of claim 11 wherein a loading funnel disposed above or upstream of the plane of the inner stationary ring and outer rotatable ring, the funnel comprising a plurality of free moving plastic sheets.

15. The apparatus of claim 11 wherein at least one of the plurality of finger assemblies can be adjusted so as to alter a predetermined shape of the bag mouth.

16. An apparatus for shaping and holding a bag in an open condition, and holding the bag in the shaped, open condition during loading of the bag with a product, wherein the bag comprises a bag mouth having an interior and exterior surface, comprising:

a) an inner stationary ring;

b) a plurality of finger assemblies, each finger assembly comprising i) a finger, the finger adapted to press against the interior of the bag mouth; and ii) a force-transferring member to which the finger is operatively connected, the force-transferring member comprising an elongate arm mounted on the inner stationary ring;

c) an outer rotatable ring, the outer rotatable ring being concentric with the inner stationary ring;

d) a push rod operatively connected to each respective finger assembly; and e) a motive device adapted to cause rotation of the outer rotatable ring relative to the inner stationary ring to effect coordinated radial movement of the fingers relative to the interior surface of the bag;

wherein the outer rotatable ring is substantially coplanar with the inner stationary ring.

17. The apparatus of claim 16 wherein the push rod is operatively connected to each respective finger assembly through a linking rod to a respective elongate arm.

18. The apparatus of claim 16 wherein the push rod is operatively connected to each respective finger assembly through a respective finger arm.

19. The apparatus of claim 16 wherein a loading funnel disposed above or upstream of the plane of the inner stationary ring and outer rotatable ring, the funnel comprising a plurality of free moving plastic sheets.

20. The apparatus of claim 16 wherein at least one of the plurality of finger assemblies can be adjusted so as to alter a predetermined shape of the bag mouth.

* * * * *